US005954240A

United States Patent [19]

Duchon et al.

[11] Patent Number: 5,954,240

[45] Date of Patent: Sep. 21, 1999

[54] DOCKING STATION AND BOTTLE SYSTEM

[75] Inventors: Brent Duchon, San Jose; Raymond McKinnon, Castro Valley, both of Calif.; Carey W. Zimmerman, Racine, Wis.; Michael J. Greaney, Castro Valley, Calif.; A. Ross Cameron, Sidney, Australia; Thomas A. Helf, New Berlin, Wis.; Charles E. Seaman, Jr., Kenosha, Wis.; John A. Boticki, Racine, Wis.

[73] Assignee: S. C. Johnson Commercial Markets, Inc., Sturtevant, Wis.

[21] Appl. No.: 09/112,092

[22] Filed: Jul. 9, 1998

Related U.S. Application Data

[62] Division of application No. 08/668,051, Jun. 14, 1996, Pat. No. 5,862,948.

[51] Int. Cl.[6] ..... B67D 1/00

[52] U.S. Cl. ..... 222/484; 222/470; 141/285; 239/318

[58] Field of Search ..... 222/324, 470, 222/472–474, 484; 141/285, 302, 309; 239/318; 220/212; 215/228

[56] References Cited

U.S. PATENT DOCUMENTS

| | | |
|---|---|---|
| D. 289,675 | 5/1987 | Beal et al. . |
| 495,299 | 4/1893 | Calcutt . |

(List continued on next page.)

FOREIGN PATENT DOCUMENTS

| | | |
|---|---|---|
| 0 160 627 A2 | 11/1985 | European Pat. Off. . |
| 0 467 513 A1 | 1/1992 | European Pat. Off. . |
| 2 581 562 A1 | 7/1920 | France . |
| 2581562 | 5/1985 | France . |
| WO 93/21103 | 10/1993 | WIPO . |

OTHER PUBLICATIONS

Dispenser Pack—Smart Cartridges Offer Premium Juice, Packaging World, A Summit Publication, vol. 3, No. 5, May 1996, 5 pgs.

Dimensions and Tolerances for Plastic bottles, The Plastic Bottle Institute, A Division of The Society of the Plastics Industry, Inc., Technical Bulletin PBI 2—1968, Revision 2—1978, 14 pgs.

Photocopy of S.C. Johnson SHOUT bottle containing stain removing liquid having a copyright date of 1994. Note the plugs provided between the cap engaging threads of the bottle.

Photocopy of Drackett bottle with Chinese lettering: believed to be about Oct. 1993. Note the taperes cap engaging lead–in thread of the bottle.

(List continued on next page.)

*Primary Examiner*—J. Casimer Jacyna

*Attorney, Agent, or Firm*—Fliesler, Dubb, Meyer & Lovejoy LLP

[57] ABSTRACT

A docking station and bottle system 23 including a filling head 20 and bottle 22 which have a head interconnect 86 and a bottle interconnect 90, respectively, for fastening the bottle 22 to the filling 20 head in order to prevent spillage. The bottle interconnect 90 includes a fluid port 106 and a vent port 104 which are simultaneously opened from a closed position in order to allow the filling head 20 to draw concentrated fluid from the bottle 22 and mix the concentrated fluid with a diluting fluid such as water before being dispensed from a filling head nozzle 52. The bottle 22 includes identifying indicia 158 for purposes of tracking utilization of the bottle and the concentrated fluid contained therein. An information storage system 170 is associated with the bottle and filling head in order to provide records of such concentrated fluid utilization. A wall mounted docking station 200 including one or more filling heads 20 is also provided for. A refill head is further provided for refilling bottle 22.

7 Claims, 21 Drawing Sheets

U.S. PATENT DOCUMENTS

| | | | |
|---|---|---|---|
| 912,106 | 2/1909 | Frazier . | |
| 1,582,429 | 4/1926 | Podel . | |
| 1,866,770 | 7/1932 | Hilgenberg . | |
| 1,920,721 | 8/1933 | Tirrell . | |
| 2,030,853 | 2/1936 | Budwig . | |
| 2,061,932 | 11/1936 | Budwig . | |
| 2,291,215 | 7/1942 | Enkur . | |
| 2,589,005 | 3/1952 | Welhart . | |
| 2,596,034 | 5/1952 | Lambert, Jr. . | |
| 2,724,583 | 11/1955 | Targosh et al. . | |
| 2,744,791 | 5/1956 | Budwig . | |
| 2,785,833 | 3/1957 | Bauerlein et al. . | |
| 2,800,313 | 7/1957 | Targosh et al. . | |
| 2,841,313 | 7/1958 | Beall, Jr. . | |
| 2,891,913 | 6/1959 | Welford . | |
| 2,919,073 | 12/1959 | Akselrad et al. . | |
| 2,940,673 | 6/1960 | Budwig . | |
| 2,948,480 | 8/1960 | Budwig . | |
| 2,951,645 | 9/1960 | Price et al. . | |
| 3,027,097 | 3/1962 | Gleason et al. . | |
| 3,032,274 | 5/1962 | Budwig . | |
| 3,034,731 | 5/1962 | Chapin . | |
| 3,072,137 | 1/1963 | McDougall . | |
| 3,088,679 | 5/1963 | Ford . | |
| 3,166,086 | 1/1965 | Holmes . | |
| 3,207,445 | 9/1965 | Court et al. . | |
| 3,323,686 | 6/1967 | Roth . | |
| 3,445,067 | 5/1969 | Sheldall . | |
| 3,470,826 | 10/1969 | Foulds . | |
| 3,770,205 | 11/1973 | Proctor et al. . | |
| 3,794,200 | 2/1974 | Marks . | |
| 3,797,747 | 3/1974 | Buzzi et al. . | |
| 3,809,272 | 5/1974 | Maki . | |
| 3,834,596 | 9/1974 | Brady et al. . | |
| 3,861,596 | 1/1975 | Nathan et al. . | |
| 3,862,640 | 1/1975 | Hechler, IV . | |
| 3,868,036 | 2/1975 | Wittwer . | |
| 3,871,662 | 3/1975 | Hepp et al. . | |
| 3,901,401 | 8/1975 | Lynn et al. . | |
| 3,917,172 | 11/1975 | O'Hare . | |
| 3,933,179 | 1/1976 | Hechler, IV . | |
| 3,938,711 | 2/1976 | Ewald et al. . | |
| 3,940,069 | 2/1976 | Gunzel, Jr. et al. . | |
| 3,958,708 | 5/1976 | Le Brun, Jr. . | |
| 4,014,363 | 3/1977 | Hechler, IV . | |
| 4,063,667 | 12/1977 | Flider | 222/470 |
| 4,068,681 | 1/1978 | McNair et al. . | |
| 4,084,717 | 4/1978 | King . | |
| 4,114,779 | 9/1978 | Stoll, III . | |
| 4,200,206 | 4/1980 | Chase et al. . | |
| 4,218,013 | 8/1980 | Davison . | |
| 4,247,080 | 1/1981 | Morrison . | |
| 4,284,201 | 8/1981 | Nixon . | |
| 4,298,018 | 11/1981 | Haggard . | |
| 4,298,129 | 11/1981 | Stull . | |
| 4,299,330 | 11/1981 | Walter . | |
| 4,369,921 | 1/1983 | Beiswenger et al. . | |
| 4,371,091 | 2/1983 | Gelina . | |
| 4,375,859 | 3/1983 | Fillmore . | |
| 4,408,626 | 10/1983 | Fujiwara . | |
| 4,418,869 | 12/1983 | Healy . | |
| 4,467,930 | 8/1984 | Hutchinson . | |
| 4,475,689 | 10/1984 | Hauger et al. . | |
| 4,493,440 | 1/1985 | von Buelow et al. . | |
| 4,527,740 | 7/1985 | Gunzel, Jr. et al. | 239/318 |
| 4,535,906 | 8/1985 | Rowekamp . | |
| 4,562,930 | 1/1986 | Lecinski, Jr. et al. . | |
| 4,583,688 | 4/1986 | Crapser . | |
| 4,610,372 | 9/1986 | Swartzbaugh . | |
| 4,643,330 | 2/1987 | Kennedy . | |
| 4,649,068 | 3/1987 | Collette . | |
| 4,653,676 | 3/1987 | Stull . | |
| 4,697,610 | 10/1987 | Bricker et al. . | |
| 4,721,220 | 1/1988 | Northup . | |
| 4,723,685 | 2/1988 | Fillmore et al. . | |
| 4,730,747 | 3/1988 | Schiemann . | |
| 4,878,619 | 11/1989 | Norman | 239/318 |
| 4,880,209 | 11/1989 | Bernat . | |
| 4,895,281 | 1/1990 | Lorenz . | |
| 4,901,923 | 2/1990 | McRoskey et al. | 239/310 |
| 4,922,960 | 5/1990 | Oelschlacgel . | |
| 4,953,728 | 9/1990 | Meek . | |
| 4,960,218 | 10/1990 | Toida et al. . | |
| 5,007,588 | 4/1991 | Chow et al. . | |
| 5,037,066 | 8/1991 | Kerger et al. . | |
| 5,039,016 | 8/1991 | Gonzel, Jr. et al. | 239/318 |
| 5,046,667 | 9/1991 | Fuhrig . | |
| 5,060,689 | 10/1991 | Csaszar et al. . | |
| 5,074,572 | 12/1991 | Delmerico et al. . | |
| 5,096,083 | 3/1992 | Shaw et al. . | |
| 5,099,882 | 3/1992 | Smith, III . | |
| 5,100,059 | 3/1992 | Englhard et al. . | |
| 5,133,498 | 7/1992 | Sealy et al. . | |
| 5,135,124 | 8/1992 | Wobser . | |
| 5,145,080 | 9/1992 | Imbery, Jr. . | |
| 5,152,504 | 10/1992 | Nixon et al. . | |
| 5,159,958 | 11/1992 | Sand . | |
| 5,213,265 | 5/1993 | Englhard et al. | 239/318 |
| 5,238,252 | 8/1993 | Stewsen et al. . | |
| 5,249,600 | 10/1993 | Blume . | |
| 5,253,677 | 10/1993 | Sand . | |
| 5,255,820 | 10/1993 | Thomas . | |
| 5,259,557 | 11/1993 | Spriggs et al. . | |
| 5,299,608 | 4/1994 | Bosyj . | |
| 5,305,778 | 4/1994 | Traylor . | |
| 5,320,288 | 6/1994 | Ketcham, Jr. . | |
| 5,326,079 | 7/1994 | Ferrando et al. . | |
| 5,332,158 | 7/1994 | Styne et al. . | |
| 5,344,074 | 9/1994 | Spriggs et al. . | |
| 5,372,310 | 12/1994 | Ketcham . | |
| 5,375,769 | 12/1994 | Schultz . | |
| 5,383,603 | 1/1995 | Englhard et al. . | |
| 5,394,999 | 3/1995 | Krall . | |
| 5,409,146 | 4/1995 | Hazard et al. . | |
| 5,431,291 | 7/1995 | LaBombarbe, Jr. . | |
| 5,439,141 | 8/1995 | Clark et al. . | |
| 5,454,476 | 10/1995 | King et al. . | |
| 5,494,174 | 2/1996 | Rohr et al. . | |
| 5,495,958 | 3/1996 | Konrad et al. . | |
| 5,544,810 | 8/1996 | Horvath, Jr. et al. . | |
| 5,573,046 | 11/1996 | Venooker et al. | 141/285 |

OTHER PUBLICATIONS

Photocopy of Happi Baby Bath sold under authorization of S.C. Johnson with Chinese lettering, believed to be about Oct. 1990. Note the cap engaging lead–in thread of the bottle as tapered and that the tapering occur about in the area of the mold part line.

DOCKING STATION AND BOTTLE SYSTEM

This application is a divisional of Ser. No. 08/668,051, filed Jun. 14, 1996 now U.S. Pat. No. 5,862,948.

CROSS-REFERENCE

The following U.S. patent applications, all owned by S.C. Johnson & Son, Inc., are cross-referenced and hereby incorporated by reference:

1. Title: MIX HEAD EDUCTOR
   Inventor: Michael J. Greaney
   Serial No.: 08/588,802
   Filed: Jan. 19, 1996
   Docket No.: GVOO 1005 SRM
2. Title: DUAL PISTON VARIABLE PROPORTIONING SYSTEM
   Inventor: Andrew I. Poutiatine
   Serial No.: Unknown
   Filed: Jun. 14, 1996
   Docket No.: GVOO 1003 SRM
3. Title: DISTRIBUTED CONCENTRATED CHEMICAL DISPENSING SYSTEM
   Inventors: Gary L. Waymire, et al.
   Serial No.: Unknown
   Filed: Jun. 14, 1996
   Docket No.: GVOO 1006 SRM

FIELD OF THE INVENTION

The present invention is directed to an apparatus which can dilute and dispense a concentrated chemical such as a cleaner or disinfectant.

BACKGROUND OF THE INVENTION

The prior art is replete with a plurality of devices for diluting and dispensing concentrated chemicals for consumer, commercial, and industrial applications. These devices have in common the purpose of using the economies of distributing chemicals in concentrated form and then diluting and dispensing the chemicals at the customer's location. The chemicals can be distributed in bottles of various shapes and sizes. In some situations, the chemicals are distributed in bottles which directly mate with the dispensing device. In other instances, the chemicals are delivered in bottles and then must be transferred at the application site to a bottle which mates with the dispensing device. These dispensing devices, by way of example only, are used for dispensing cleaners, disinfectants, waxes, fertilizers, weed killers, and the like.

For such devices, and in particular for industrial and commercial devices and systems, it is highly economically advantageous to be able to ship and distribute chemicals in very high concentrations. Such high concentrations, however, can be poisonous, and personnel contacting or using such materials must exercise care when handling containers of such concentrated materials. Thus, user safety becomes an important issue with respect to such dispensing devices and systems. Ideally, a dispensing head would attach to a bottle of concentrated chemical, which bottle is otherwise initially completely enclosed and sealed. The bottle seals should be opened only when said bottle comes into communication with the dispensing head. In such a system the concentrated chemicals could not be spilled from or leak from the bottle. Further, the dispensing head needs to be designed in such a manner that the concentrated chemicals cannot be dispensed by themselves, but only in a solution of concentrated chemicals and a diluting fluid such as water.

Prior systems include bottles with dispensing ports and venting ports. However, the operation of these ports is often not coordinated well and there remains the possibility that fluids can be dispensed inadvertently from these ports.

Another safety issue is the proper disposal of a spent bottle. If the bottle is to be disposed of either through recycling the raw materials or through a landfill, it is important that the dispensing head remove and dispense as much of the concentrated chemicals as possible leaving little or no concentrated chemicals in the bottle.

In addition to the above, the prior art lacks any method or system for accounting for and tracking the amount and type of concentrated chemicals that are being dispensed in order to monitor the efficient use of the concentrated chemicals.

SUMMARY OF THE INVENTION

The present invention is directed to overcoming and greatly enhancing upon the prior art by providing a docking station and bottle system which includes a filling head and a bottle for containing concentrated chemicals in order to safely and accurately dilute and dispense concentrated chemicals at a desired location.

Accordingly, an embodiment of the invention includes a docking station and bottle system comprising a filling head with a head interconnect and a bottle with a bottle interconnect. The bottle interconnect includes a fluid port and a vent port, and the head interconnect is configured to mate with the bottle interconnect. The head interconnect includes an actuator that can cause the fluid port and vent port to open.

In another aspect of the invention, the actuator is movable between a first position and a second position in order to open the fluid port and the vent port simultaneously.

In still another embodiment of the invention, a bottle is provided which has a fluid port and a vent port and a device which can selectively cause said fluid port and vent port to open in order to dispense fluid from the bottle.

In a further aspect of the bottle of the invention, the vent port is located about the fluid port. Further, the vent port includes a plurality of individual ports which are located about said fluid port. Each of said individual ports are located on a radii extending from the fluid port. A plunger is provided for movement relative to the fluid port and the vent port in order to open the ports simultaneously for venting the bottle through the vent port while dispensing concentrated chemicals through the fluid port.

In yet another aspect of the invention, multiple filling heads are assembled to a manifold and preferably affixed to a wall in order to provide a multiple filling head docking station which can dispense two or more different concentrated chemicals.

In another embodiment of the invention, a filling head is provided which is portable and which can be connected to a source of water through a flexible conduit.

In yet a further aspect of the invention, the filling head includes a probe and the bottle includes an indentation which can receive the probe in order to ensure that the bottle is secured to the filling head in a desired orientation so that, for example, the contents of the bottle can be efficiently and substantially completely depleted by the filling head without any significant residual fluid left in the bottle.

In still a further aspect of the invention, the bottle is encoded with an identifying indicia and the filling head has a device which can read the indicia. The indicia allows for accurate records to be kept by an information storage device with respect to the utilization of concentrated chemicals.

Still a further aspect of the invention includes a system with a filling head and bottle wherein the filling head has a head interconnect and the bottle has a bottle interconnect. One of the head interconnect and the bottle interconnect has a first thread being one of (1) reduced in size or (2) eliminated in a first region. The other of the head interconnect and the bottle interconnect has a protrusion which is received in the first region in order to position the bottle relative to the filling head. Such an embodiment has a number of advantages. The first advantage is that the bottle can be accurately positioned and registered with respect to the filling head so that all the other interconnect mechanisms which affords the dispensing of fluid from the bottle through the filling head are properly aligned. Further, such a system ensures that the bottle can be molded in an inexpensive and efficient manner.

A further aspect of the invention is a refill head for refilling the bottle.

Thus, according to the above it can be seen that an object of the invention is provided for a filling head, a bottle, a docking station and bottle system and an encoding system in order to satisfy the needs not addressed by the prior art.

It is the object of the present invention to provide for filling heads, bottles, and systems which are safe to use and do not expose the user to a potential of spillage of concentrated chemicals.

It is a further object of the present invention to provide filling heads, bottles, and systems which are easy to use, convenient to connect, and efficient in that any concentrated chemicals can be diluted by a desirable ratio.

It is yet another object of the present invention that the bottle can easily be secured to the filling head with a proper orientation without spillage of concentrated chemicals.

It is a further object of the present invention to provide for a system for tracking usage of concentrated chemicals by providing encoding indicia on the bottles and indicia readers on the filling heads. An information storage device can be connected to the filling head readers in order to record the usage of the bottles and concentrated chemicals.

Other objects, aspects and advantages of the invention can be obtained from a view of the specification, the figures and the claims.

DETAILED DESCRIPTION OF THE PREFERRED EMBODIMENT

Figure 1:
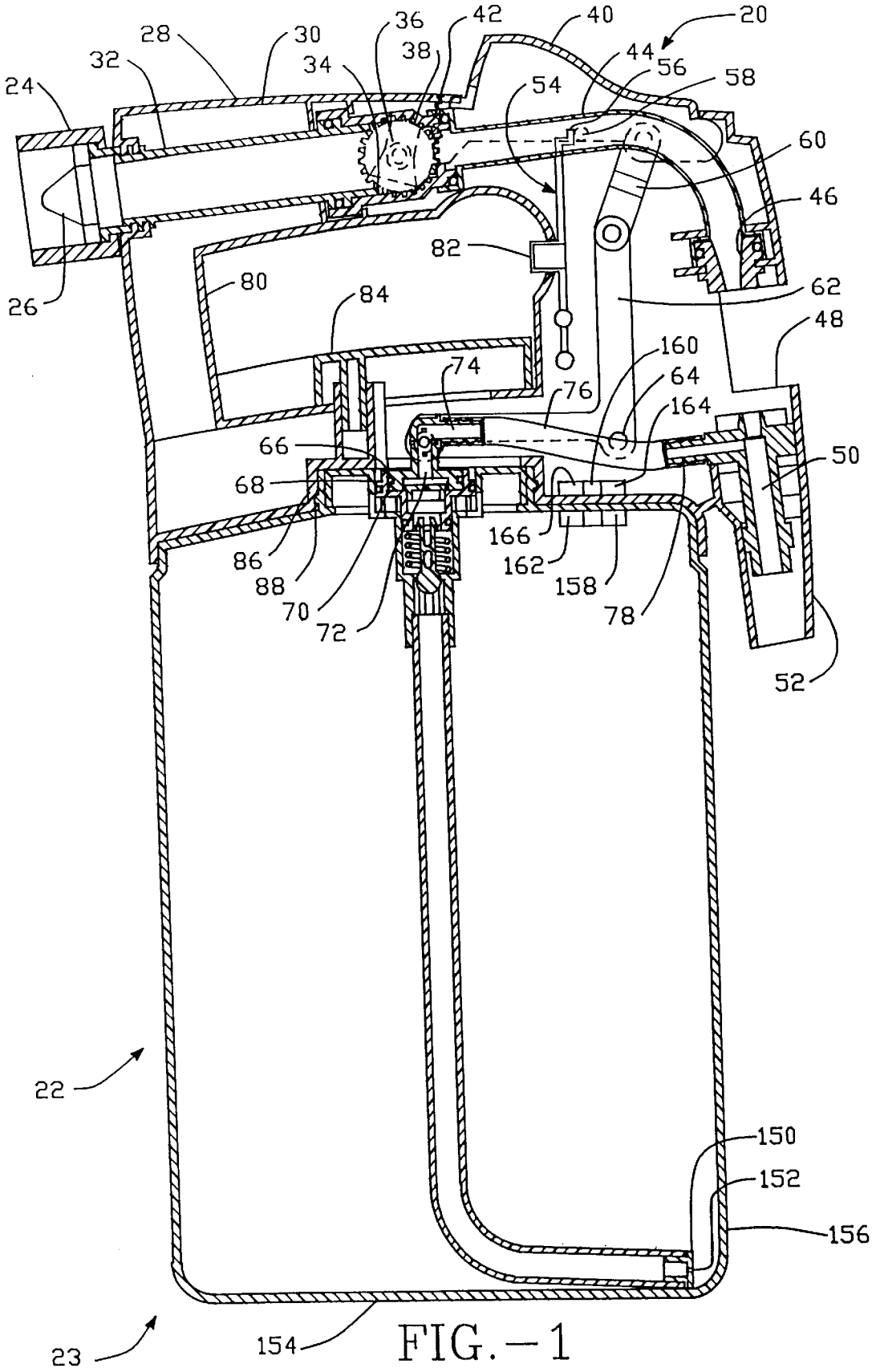
FIG. 1 is a side cross-sectional view of the filling head of the invention secured to the bottle of the invention.
Figure 2:
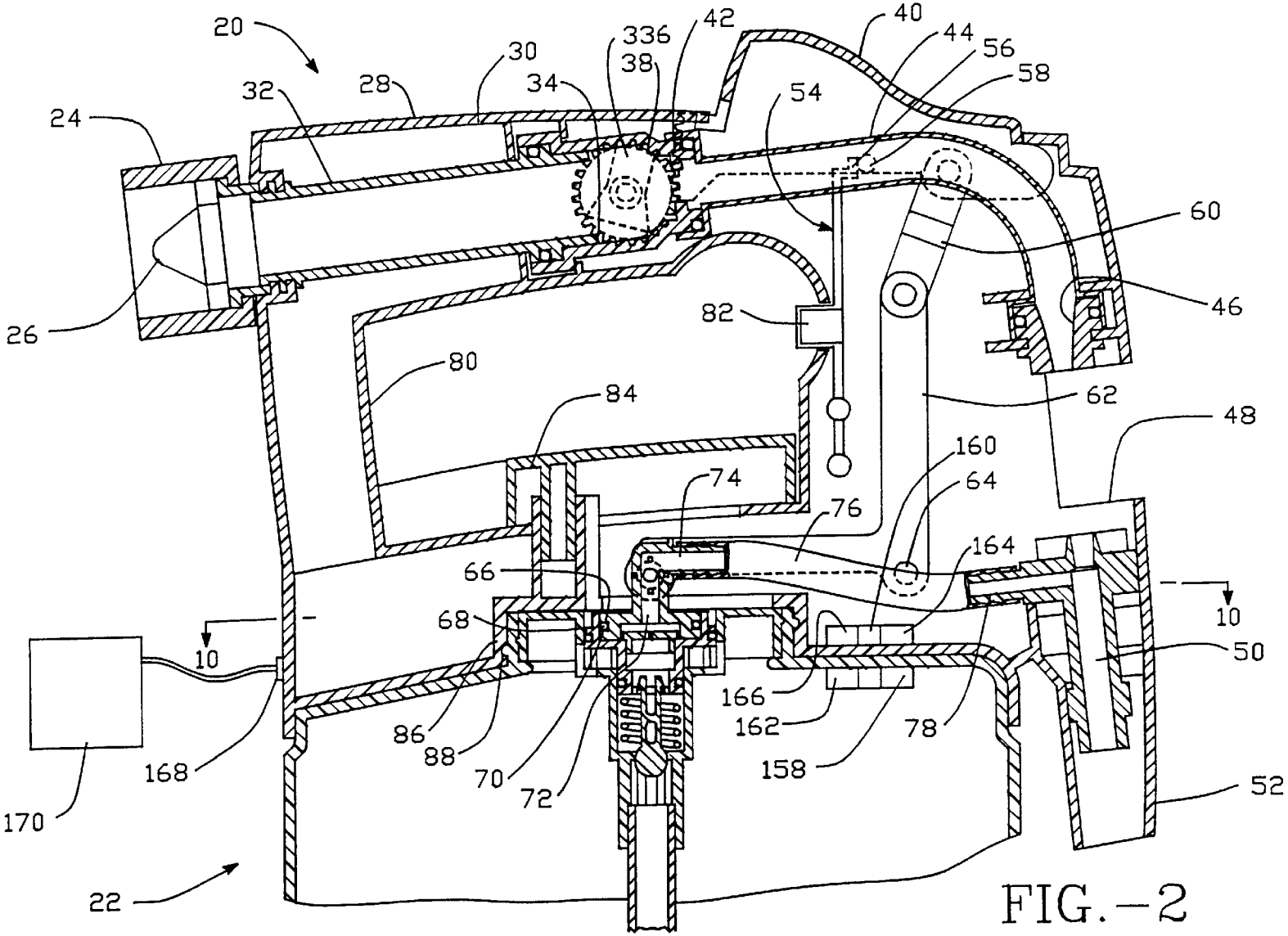
FIG. 2 is a side cross-sectional view focusing on the filling head of the invention.

With reference to the figures, and in particular to FIGS. 1 and 2, an embodiment of the filling head 20 and bottle 22 of the docking station and bottle system 23 of the invention is depicted. The filling head 20 of FIGS. 1 and 2 is meant to be portable and connected to a source of water through a flexible conduit such as a hose. Accordingly, the embodiment of filling head 22 includes a hose connector 24 with a filter screen 26. Hose connector 24 is mounted to the handle 28 of the filling head 20. Handle 28 includes a housing 30 which encases a swivel fitting 32 which connects the hose connector 24 to a valve housing 34 which houses a ball valve 36. A valve pinion 38 is used to cause the ball valve 36 to open and close. The filling head 20 includes a trigger 40 which is pivotally mounted to the housing 30. Trigger 40 includes a rack 42 which operatively engages the valve pinion 38. Accordingly, as the trigger is depressed, the rack 42 causes the valve pinion 38 and the ball valve 36 to rotate about its axis opening the valve to allow a source of fluid, preferably water, enter fluid supply tube 44. From fluid supply tube 44 the water is directed by a nozzle head 46 through an air gap 48 to an eductor 50 and is dispensed through filling nozzle 52. As the source of diluting fluids such as water must go through eductor 50 prior to the eductor generating sufficient vacuum to draw a concentrated chemical from the bottle 22, the filling head 20 will not dispense concentrated chemicals which can be potentially poisonous or caustic without first diluting them with an appropriate ratio of water.

An eductor suitable for use as eductor 50 is disclosed in U.S. patent application entitled MIX HEAD EDUCTOR filed on Jan. 19, 1996, and given U.S. patent application Ser. No. 08/588,802. The application lists Michael J. Greaney as the inventor. This application has been assigned to the present assignee. Other types of eductors can also be used with the system disclosed herein.

The filling head 20 further includes a trigger lock mechanism 54 which can lock the trigger with the ball valve 36 in the open position by causing leg 56 of the trigger lock mechanism 54 to engage and hold down pin 58 of the trigger 40. Button 82 operates the trigger lock mechanism 54.

Simultaneously with the opening of ball valve 36, the trigger mechanism causes the fluid and vent ports of the bottle 22 to be opened so that concentrated chemicals in the bottle can be drawn up by the eductor 50 and mixed with the diluting fluid in eductor 50 in a manner as described below.

Trigger 40 is pivotally connected to a small link 60 which is pivotally connected to a bell crank 62. Bell crank 62 is pinned about pivot point 64. Pivotally connected to bell crank 62 is a actuator or plunger 66. Plunger 66 is substantially circular in shape and includes an elastomeric O-ring 68 retained in a peripheral groove 70. Plunger 66 includes a recessed cavity 72 which is cylindrical in shape and centrally located within said plunger 68. The recessed cavity 72 communicates with an elbow connector 74. Connected to the elbow connector 74 is a flexible conduit 76. Flexible conduit 76 is additionally secured to inlet port 78 of eductor 50 in order to provide concentrated chemicals to eductor 50.

Within the filling head 20 is an internal user hand engagement space 80. In this engagement space 80, the button 82 is located which operates the trigger lock mechanism 54. Also within this hand engagement space 80 is a quarter turn locking handle 84. This locking handle 84 is operatively secured to a filling head interconnect mechanism 86, which mechanism is disposed about and also comprises the plunger or actuator 66. The interconnect mechanism 86 includes a quarter turn thread 88 which engages the bottle 22 as will be described hereinbelow.

Figure 3A:
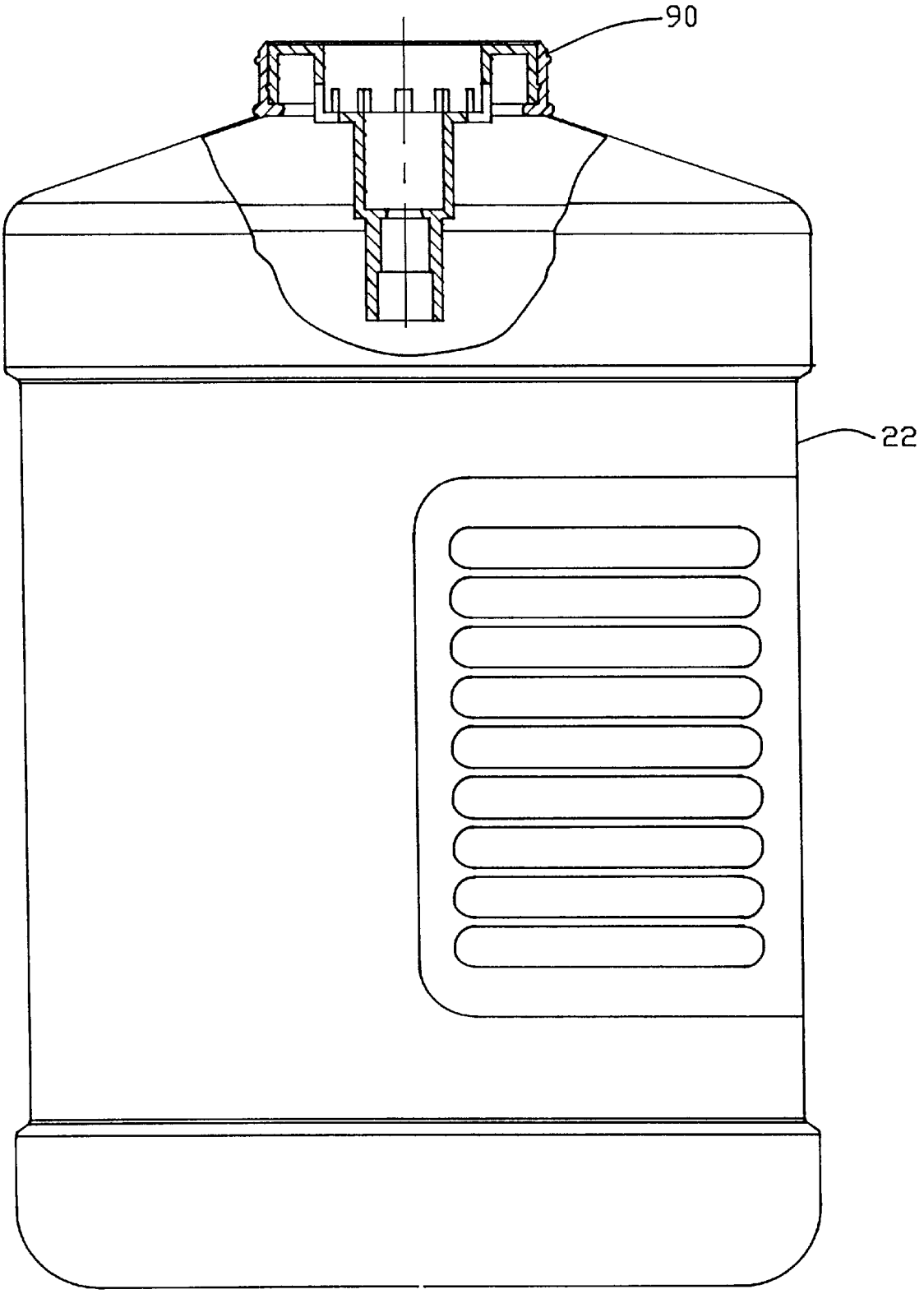
FIG. 3*a* is a side view partially cross-sectioned of the bottle interconnect mechanism of the invention with the valving mechanism removed to show the vent and fluid ports more clearly.
Figure 3B:
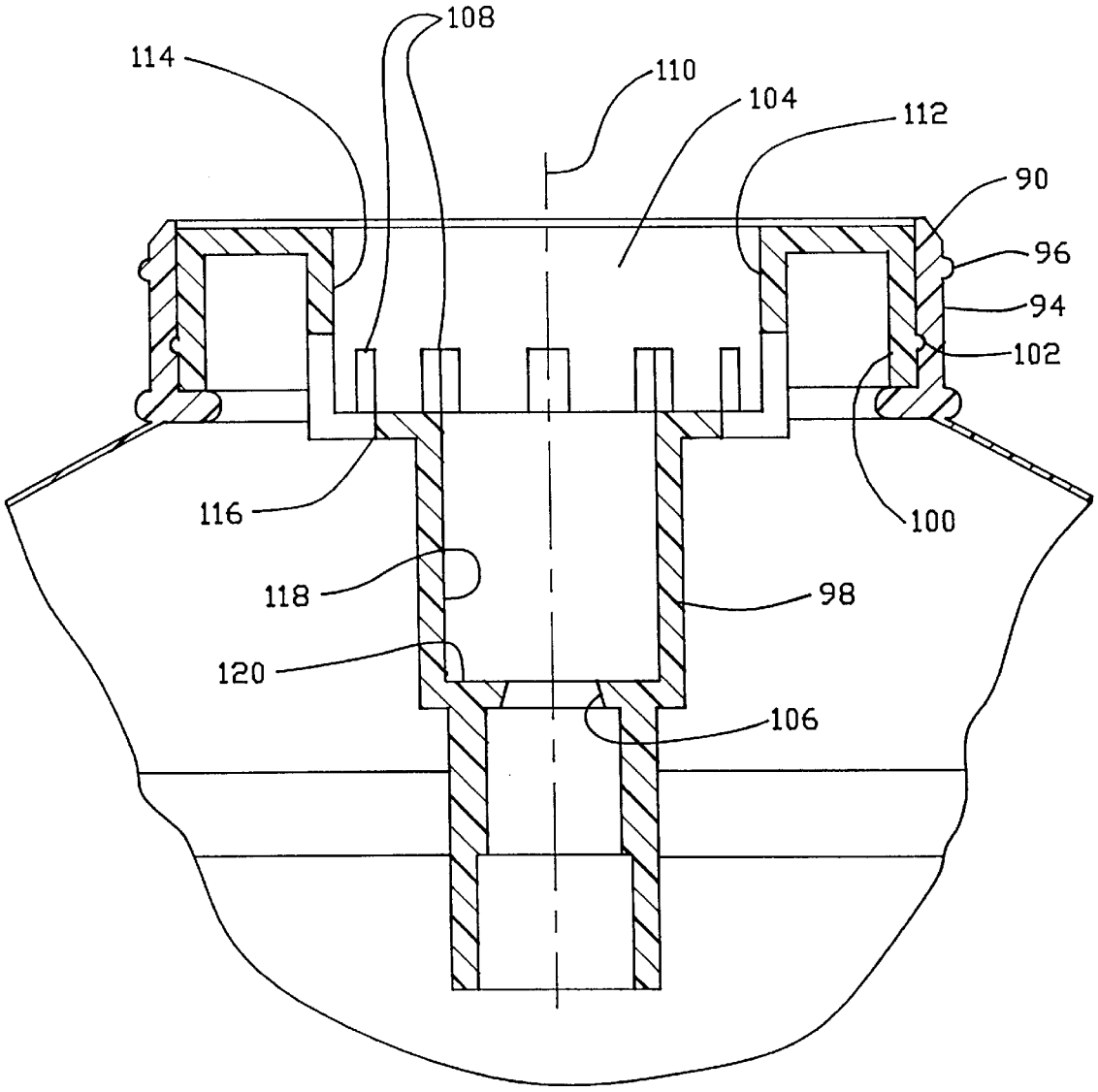
FIG. 3*b* is an enlarged view of the bottle interconnecting mechanism shown in FIG. 3*a*.

An embodiment of the bottle 22 of the invention can be seen in greater detail collectively in FIGS. 3*a*, 3*b*, 4*a*, and 4*b*. FIG. 3*b* shows an enlargement of the bottle interconnect mechanism 90 without a valve mechanism 92 which will be more fully described with respect to FIGS. 4*a* and 4*b*. The bottle interconnect mechanism 90 includes an upstanding collar 94 which has defined thereon a quarter turn thread 96 which is compatible and mates with the quarter turn thread 88 of the fill head interconnect mechanism 86 as seen in FIGS. 1 and 2. A valve housing insert 98 is received inside of upstanding collar 94. The valve housing insert 98 includes a peripheral collar 100 which can snap into the upstanding collar 94 through the use of a detent arrangement 102. The valve housing insert 98 includes a vent port 104 and a fluid port 106. As can be seen in FIG. 3*b*, the vent port 104 includes a plurality of individual vent ports 108 which are L-shaped in cross-section and which radiate outwardly from a central axis 110. In a preferred embodiment, the individual vent ports 108 are located equally spaced about the first cylindrical cavity 112 of the valve housing insert 98. The individual vent ports 108, being L-shaped, are defined both on the peripheral wall 114 of the first cylindrical cavity 102 and also in the base 116 of the first cylindrical cavity 112.

Located immediately below the first cylindrical cavity is a second cylindrical cavity 118 which is concentric about the axis 110. This second cylindrical cavity 118 defines in its base 120 the fluid port 106. It can be seen from FIG. 3*b* that fluid port 106 has a curved wall that is designed to accept a ball valve as more fully described below.

Figure 4A:
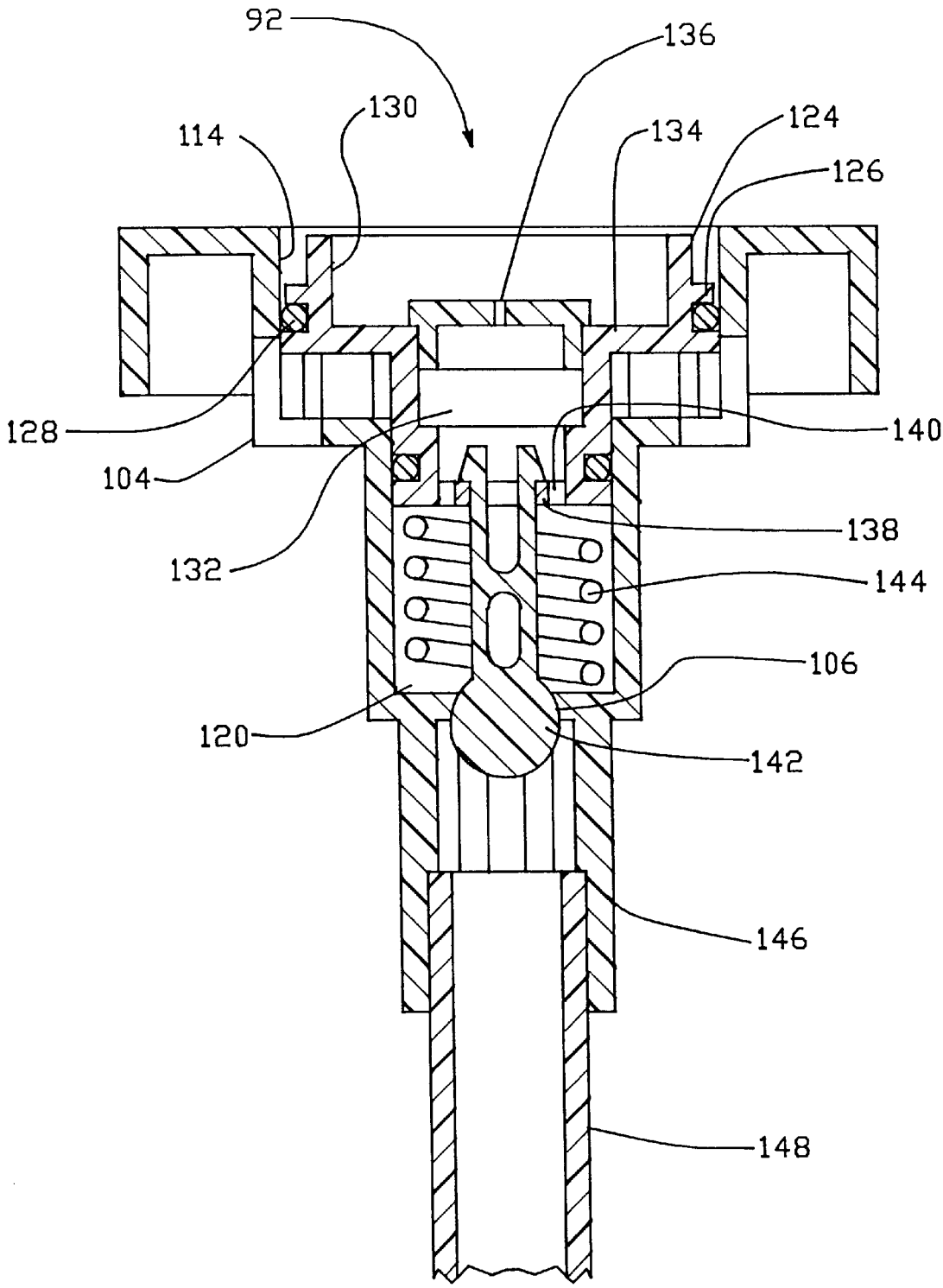
FIG. 4*a* is a cross-sectional view of the interconnecting mechanism of the bottle including the valve mechanism for opening and closing the fluid and vent ports of the bottle, with the valve mechanism in a closed position.
Figure 4B:
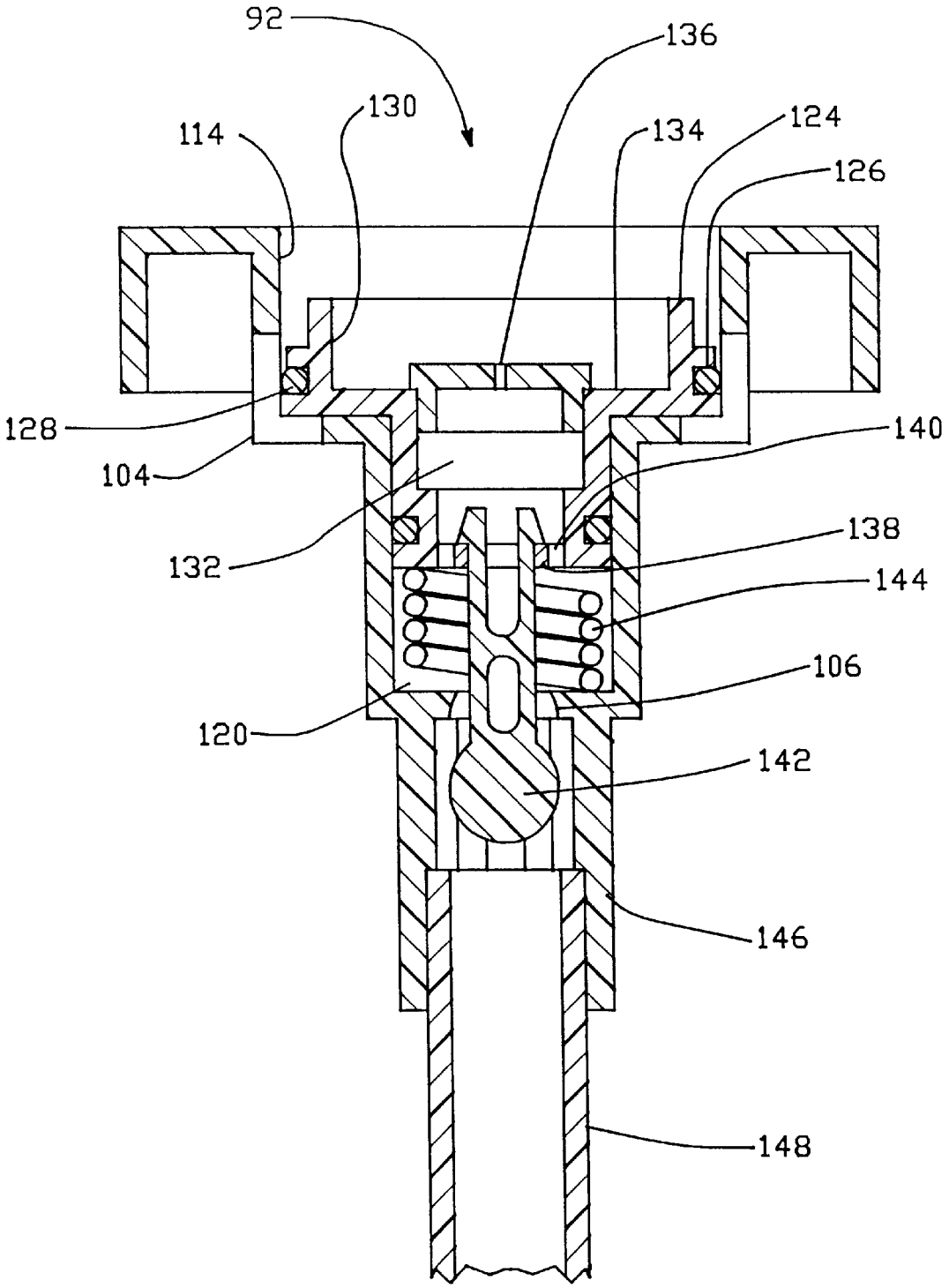
FIG. 4*b* is similar to FIG. 4*a* with the valve mechanism for opening and closing the fluid and vent ports depicted in an open position.

Turning to FIGS. 4*a* and 4*b*, the valve mechanism 92 of the bottle is presented. In FIG. 4*a* the valve mechanism 92 is positioned in a first position to close off the vent port 104 and the fluid port 106. In FIG. 4*b* the valve mechanism 92 has been depressed in order to open up the vent port 104 and the fluid port 106. In actual operation, the movement of the valve mechanism 92 is accomplished by the movement of the plunger 66 of the filling head 22 from a first to a second position as the trigger 40 of the filling head 20 is depressed.

The valve mechanism 92 includes a valve plunger 124 which is substantially cylindrical in shape and is received in the first cylindrical cavity 112 of the valve housing insert 98. The valve plunger 124 includes a peripheral groove 126 which receives an O-ring 128. O-ring 128 rubs against and creates a seal with peripheral wall 114 in order to selectively seal off or open the vent port 104. Valve plunger 124 has a first cylindrical cavity 130 and a second cylindrical cavity 132. At the base 134 of the first cylindrical cavity 130, a metering orifice 136 is positioned. This metering orifice can be omitted or changed in order to adjust the dilution ratio of the filling head 20 and bottle 22 and still be within the spirit and scope of the invention. At the base 138 of a second cylindrical cavity 132 a plurality of passages 140 are provided for allowing the concentrated chemicals to pass. Secured to the base 138 is a ball 142 which can selectively seat against the fluid port 106 in order to open or close the fluid port 106. A valve spring 144 is contained within the second cylindrical cavity 118 of the valve housing insert 98 and is biased between the base 120 of the second cylindrical cavity 118 and the base 138 of the second cylindrical cavity 132 of the valve plunger 124. An insert collar 146 extends from the base 120 of the second cylindrical cavity 118 of the valve housing insert 98. Fitted into collar 146 is a concentrated chemical pick-up tube 148 which at its distal end 150 includes a metering orifice 152 (FIG. 1). In a preferred embodiment, the distal end 150 and the metering orifice 152 are disposed on the base 154 of the bottle 22 adjacent to the front wall 156 of the bottle 22. As the bottle is meant to tilt at about a 5° angle forwardly relative to the filling head 22, whether the filling head 22 is permanently mounted to a wall or handheld, the position of the metering orifice 152 adjacent the front wall 156 allows the filling head 22 to remove substantially all of the concentrated chemicals in the bottle, while leaving only a very small residual amount.

In an alternative embodiment, the spring 144 which biases the ball 142 to a closed position can be placed elsewhere, as for example, in the filling head 20 in order to perform a like function. Further, in an alternative embodiment, the metering orifice 150 can be removed.

FIGS. 16, 17*a*, 17*b* and 17*c* depict a preferred embodiment 700 of the valve mechanism 92 (FIGS. 4*a* and 4*b*) of the bottle interconnect mechanism 90 (FIG. 3*b*). The mechanism 700 has been designed for enhanced manufacturability and retains all the novel features previously described. The preferred valve mechanism 700 includes a valve housing insert or valve plug 702, a valve plunger or concentrate valve 704, a valve sleeve 706, a valve retainer 708 and a spring 710. Also shown in FIGS. 17*a* and 17*b*, valve mechanism 700 mates with a plunger 712 which forms part of a filling head, such as filling head 20 in FIG. 1. Inserted in plunger 712 is a metering orifice 714. The metering orifice 714 can be removed or changed for another size orifice in order to vary the flow rate of concentrate to the plunger 712. In this embodiment, located between plunger 712 and metering orifice 714, is a duckbill checkvalve 715 which prevents the leakage of fluid from the plunger 712 when the filling head 20 is removed from bottle 22. Further checkvalve 715 prevents any back flow of fluid from filling head 20 into bottle 22.

Figure 16:
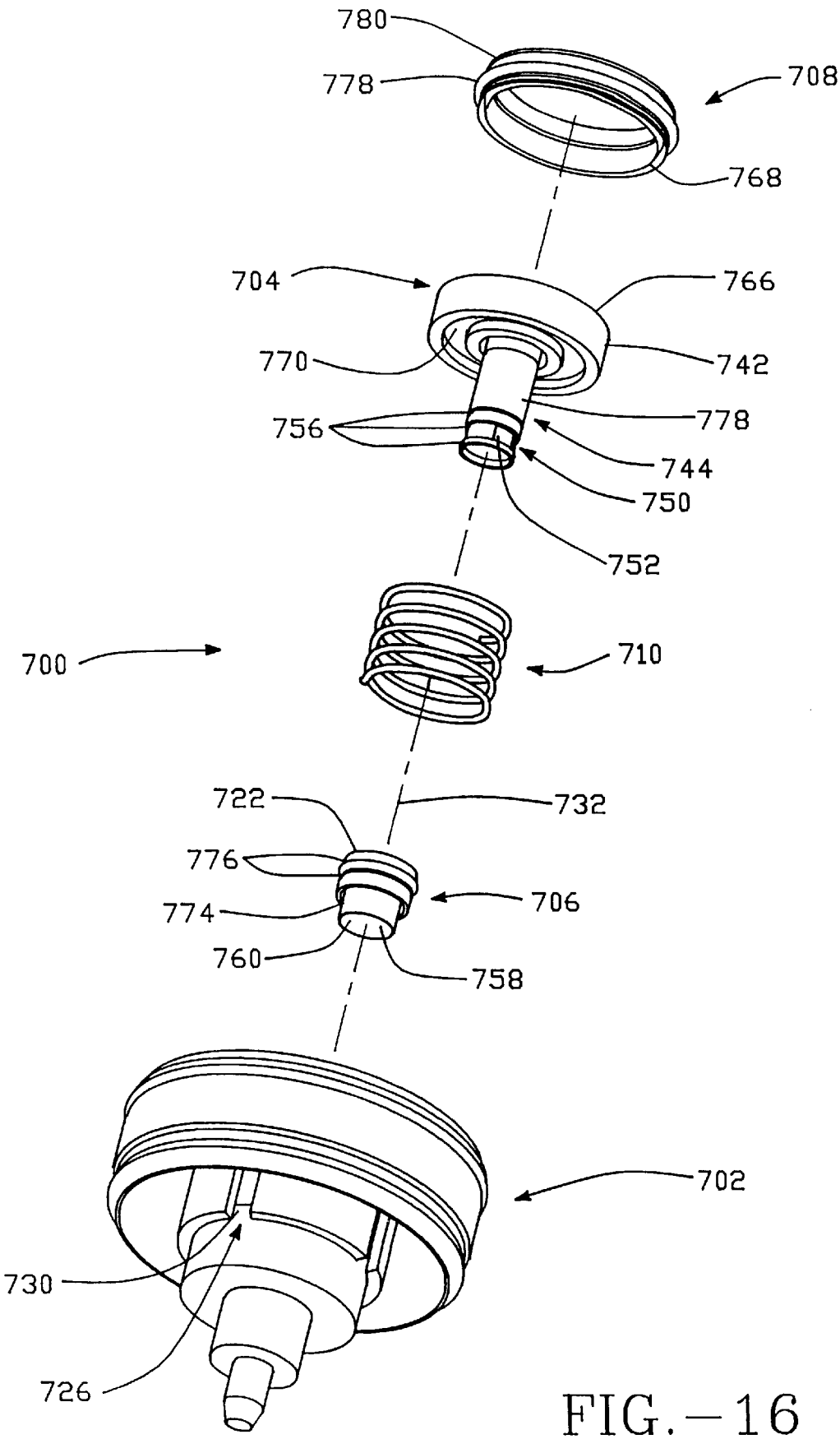
FIG. 16 is an exploded view of a preferred embodiment of a valve mechanism of the bottle interconnect mechanism for opening and closing the fluid and vent ports of the bottle.
Figure 17A:
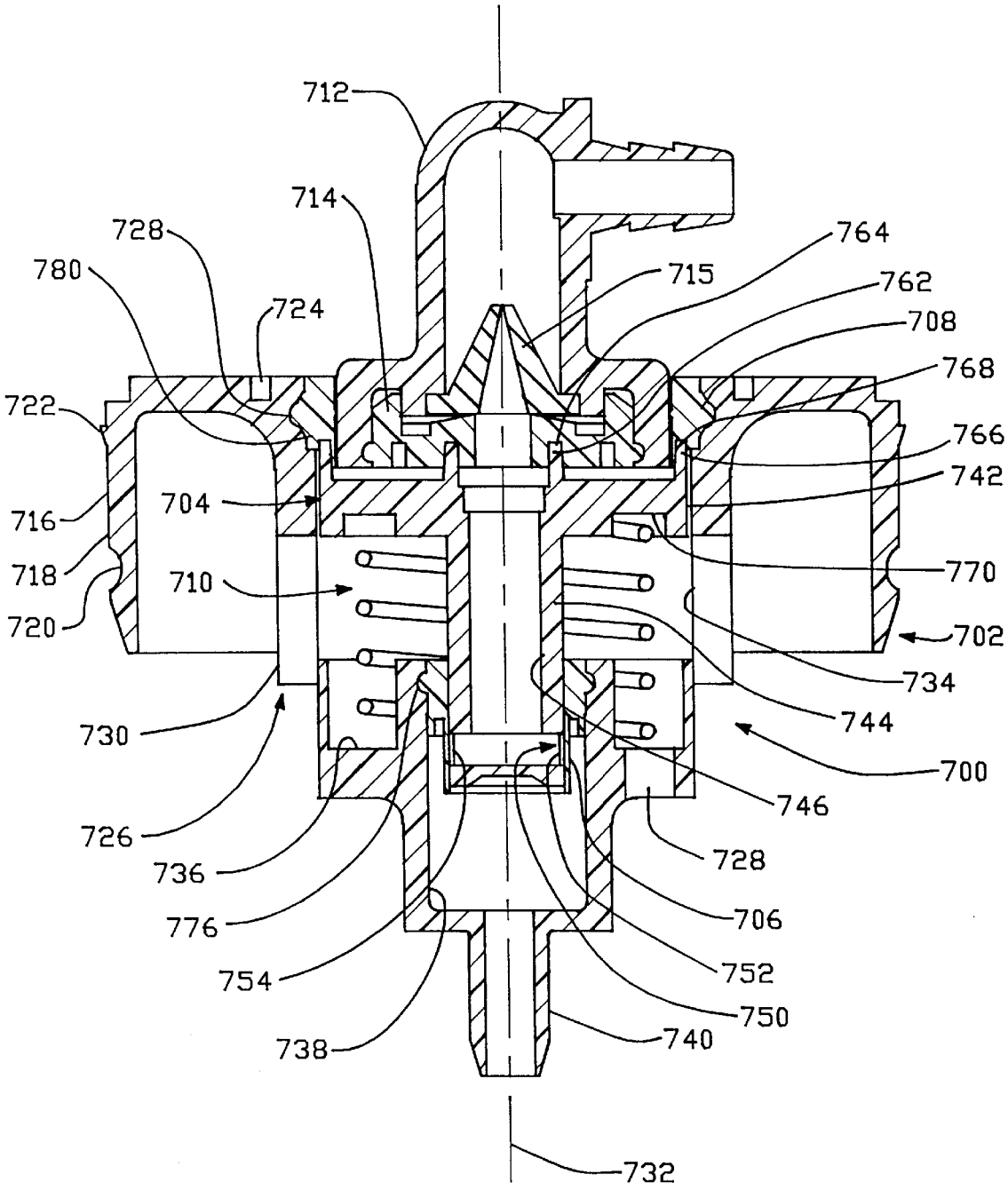
FIG. 17*a* is a cross-sectioned view of the valve mechanism of FIG. 16 with the valve mechanism in a closed position and shown with a plunger from a filling head.
Figure 17B:
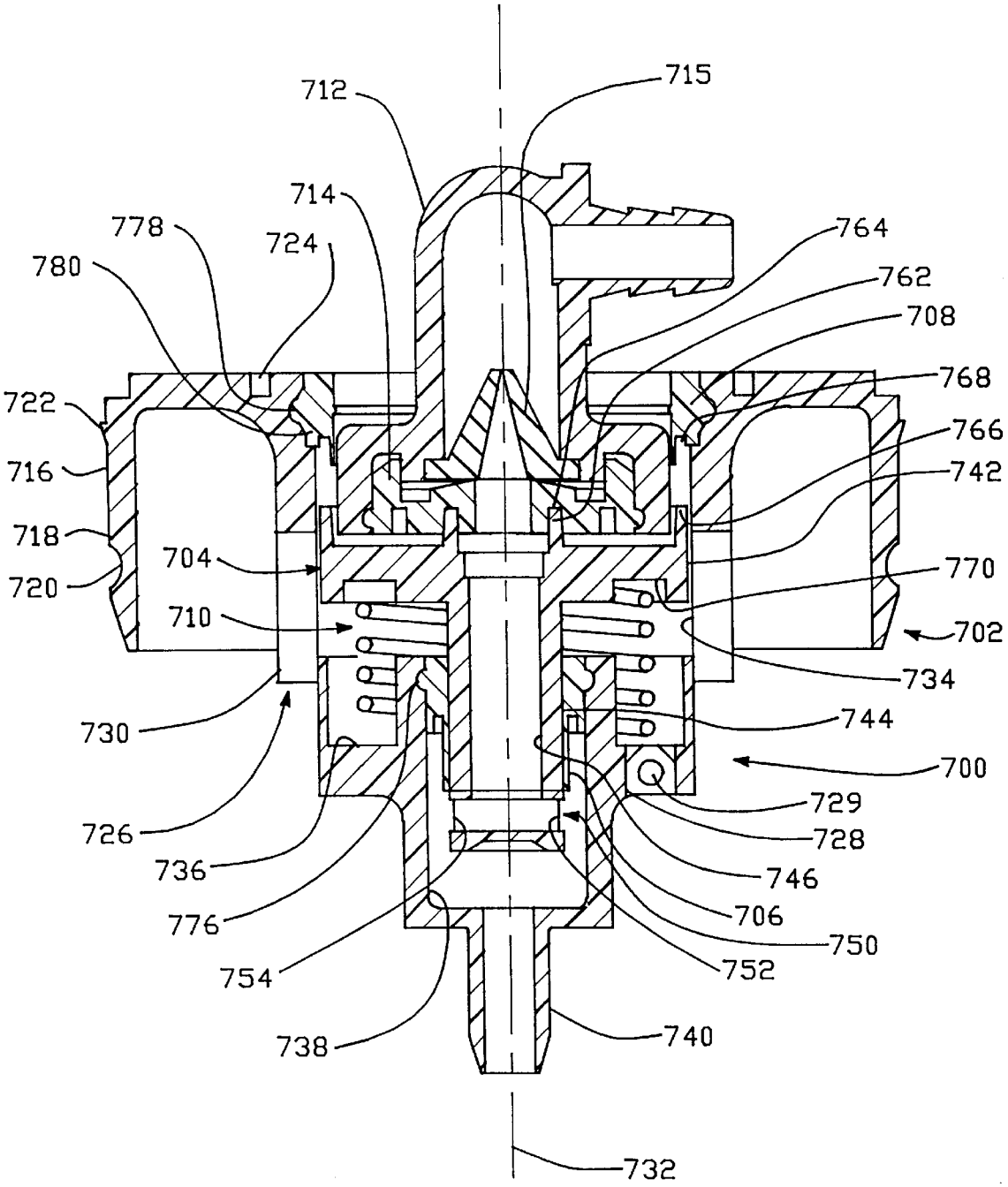
FIG. 17*b* is a view similar to FIG. 17*a* with the valve mechanism in the open position.

The valve plug or valve housing insert 702 as seen in FIGS. 16, 17*a* and 17*b*, includes a peripheral collar 716 which can snap into the upstanding collar 94 (FIG. 3*b*) of a bottle, such as bottle 22, through the use of a detent arrangement 718 which includes a female locking ring 720 which can mate with a male locking ring (not shown) of the bottle 22 to provide the primary bottle seal. The peripheral collar 716 also includes a barb sealing bead 722 which is located above the female locking ring 720. The barb sealing bead 722 provides a force fit between the valve plug 702 and the bottle 22 and acts as a secondary seal to retain the liquid in bottle 22. The valve plug 702 further includes a hinged valve retainer ring 724 which is flexible and allows the valve retainer 708 to be forced fit into the valve plug 702. Ring 724 also permits valve plug 702 to be molded without an internal mold parting line for better sealing because ring 724 can flex to permit the mold insert forming the interior to be removed.

As with the embodiment of FIGS. 4*a* and 4*b*, the valve plug 702 includes a vent or refill port 726. Vent port 726 allows make up air to be received in the bottle 22 in order to displace concentrate that is drawn from the bottle and also permits bottle 22 to be refilled with liquid. As can be seen in FIGS. 16, 17*a*, 17*b*, and 17*c*, vent port 726 includes a plurality of individual vent ports 730 which are rectangular in shape in this embodiment, and which are located on radii which project outwardly from a central axis 732. In a preferred embodiment, the individual vent ports 730 are located equally spaced about a first cylindrical cavity 734 (FIG. 17*a*) of the valve plug 702.

Immediately below the first cylindrical cavity 734 is a second cylindrical cavity 736. This cavity receives the lower end of the spring 710 and holds it in position. A drain or vent port 728 is provided through the wall of the second cylindrical cavity 736. Drain port 728 drains any fluid retained in the second cylindrical cavity 736 back into the bottle and can also serve as an air vent.

In an alternative embodiment where the bottle 22 is only intended for one time use, individual vent ports 730 of vent port 726 can be eliminated and drain port 728 can serve to allow make up air to be received within bottle 22. A check valve such as a ball check valve 729 can be engaged with drain port 728 to minimize escape of liquid from bottle 22 in case bottle 22 is squeezed while the plunger of concentrate valve 704 is deliberately held open when it is not connected to filling head 20. Although check valve 729 is shown in the embodiment of FIG. 17*b*, check valve 729 can be eliminated from this embodiment (as shown in FIG. 17*a*) and be within the spirit and scope of the invention.

Inwardly and downwardly from the second cylindrical cavity 736 is a third cylindrical cavity 738 which receives the valve sleeve 706 in order to properly position the plunger or valve 704 relative to the valve plug 702. Valve sleeve 706 is preferably press fit into position. Extending downwardly and communicating with the third cylindrical cavity 738 is a nipple 740 to which a draw tube can be received in order to draw fluid out from the bottle 22.

The plunger or concentrate valve 704 includes a squat cylindrical body 742 with a hollow cylindrical column 744 extending downwardly therefrom along a central axis 732. At the distal end of the cylindrical column 744 and defined through the exterior cylindrical surface 748 is a fluid port 750 which includes individual fluid ports 752 and 754. Concentrated fluid can be drawn through the individual fluid ports 752, 754 up through the internal conduit 746 through the metering orifice 714 and through the plunger 712 in order to be dispensed by filling head 20 of FIG. 1. As can be seen in FIG. 16, positioned below and above the fluid ports 750 are sealing beads 756. These sealing beads 756 rub against the internal cylindrical surface 758 of the cylindrical bore 760 of valve sleeve 706 (FIG. 16). These sealing beads 756 cause fluid port 750 to be sealed relative to the internal cylindrical surface 758 so that fluid cannot be drawn through the valve mechanism 700 with the valve in the closed position as shown in FIG. 17*a*. The sealing bead 756 below fluid ports 750 is slightly larger in diameter than the other two sealing beads 756 to provide better sealing. More than three sealing beads 756 could be present for better sealing although more beads 756 tend to create more resistance to opening the plunger. Fewer than three or no sealing beads 756 can also be used and still obtain good sealing. With the valve mechanism 700 in the open position shown in FIG. 17*b*, and with the concentrate valve 704 urged against the spring 710, the fluid port 750 extends below the distal end of the valve sleeve 706 so that vacuum can be delivered through the plunger 712 and the valve mechanism 700, to the fluid inside the bottle in order to draw concentrated fluid through the fluid port 750. Further, as can be seen in FIG. 17*b* with the valve mechanism 700 in the open position, with the concentrate valve 704 positioned downwardly, the vent port 726 is opened, allowing air to enter the bottle and replace fluid that is drawn out of the bottle. In the open position of FIG. 17*b*, sufficient air can pass between the valve 704 and the wall of the first cylindrical cavity 734, which are slightly spaced apart, and through vent port 726 to vent the bottle 22. The above is due to the fact that sealing of the vent port 726 primarily occurs as shown in FIG. 17*a* when the top sealing ring 766 of the valve 704 is received in the annular recess 768 of the valve retainer 708, where contact by sealing ring 766 with the angled sides of recess 768 provides a primary seal and contact with the bottom of recess 768 provides a secondary seal.

Figure 17C:
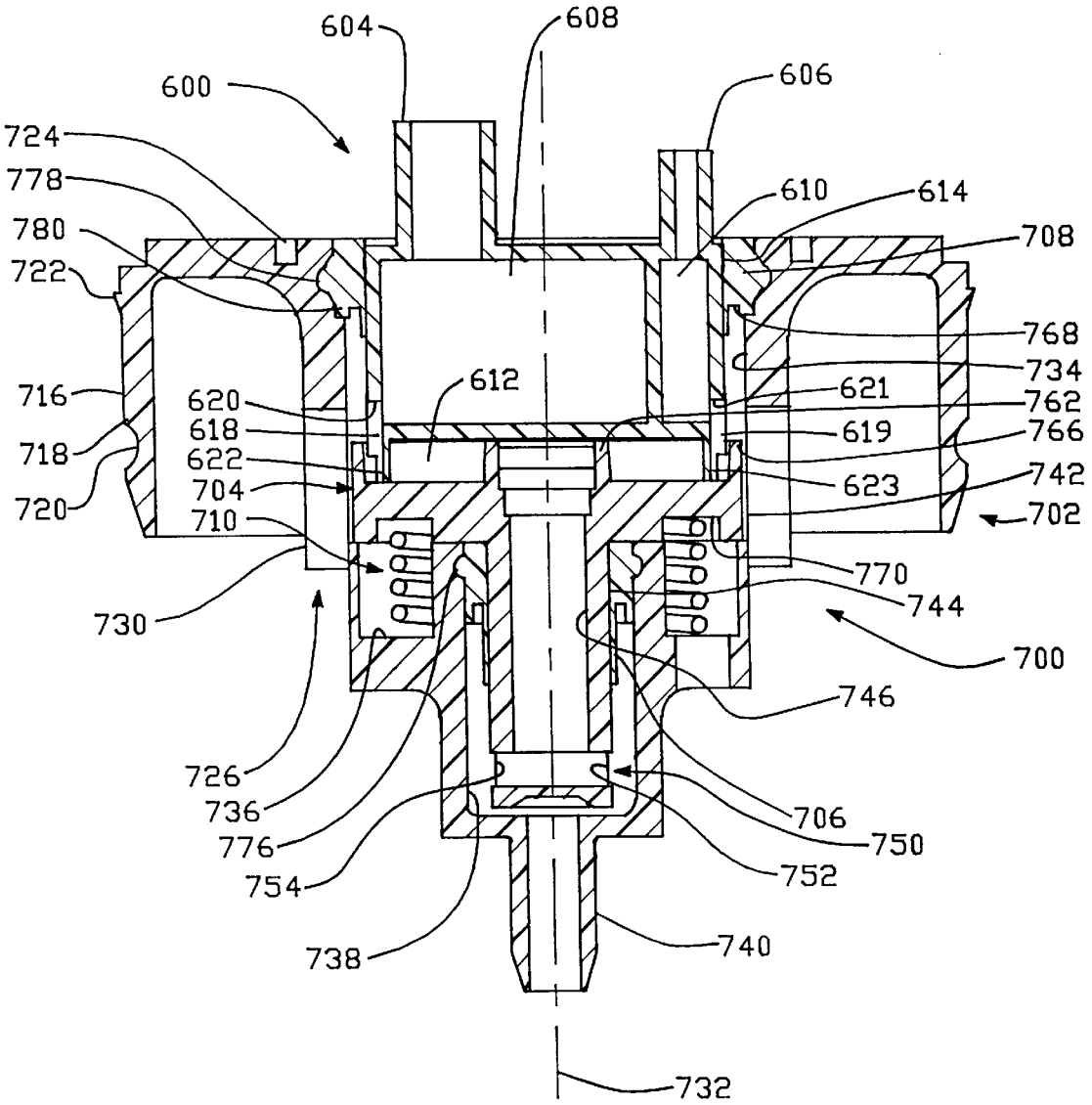
FIG. 17*c* is a view similar to FIG. 17*a* with the valve mechanism in the refill position, and with a refill head plunger.

As shown in FIG. 17*c*, the valve mechanism 700 has a refill position whereby the valve 704 is urged further downwardly and at least partially past the vent port 726. With the valve 704 so positioned, and with a refill head 600 such as shown in FIGS. 15*a*–15*g* positioned on the valve 704, the bottle can be rapidly refilled with concentrated fluid. It is noted that the refill head depicted in FIG. 17*c* serves the same function as that depicted in FIGS. 15*a*–15*g*, but is slightly elongated in FIG. 17*c*.

The concentrate valve 704 further includes an annular sealing bead 762 which is upstanding from the cylindrical body 742. The sealing bead 762 is received in a annular recess 764 defined in the metering orifice 714. With a plunger 712 received on the concentrate valve 704 as shown in FIGS. 17*a*, 17*b*, and 17*c*, the sealing bead 762 being received in the annular recess 764 ensures that there is no leakage between the valve mechanism 700 and the filling head 20 (from FIG. 1). The concentrate valve 704 further includes a top sealing ring 766 that is received in annular recess 768 of the valve retainer 708 in order to create a seal between the valve 704 and the valve retainer 708 with the valve 704 in a closed position as shown in FIG. 17*a*. The valve 704 further includes a spring guide 770 which retains the top portion of the spring 710.

The valve sleeve 706 as described above provides for sealing of the fluid port 750 with the valve 704 in the closed position as shown in FIG. 17*a*. The valve sleeve 706 includes a body 722 and a sleeve 774 extending downward therefrom. The cylindrical bore 760 is defined inside of the sleeve 774. The sleeve 774 is sized to allow for some expansion as the valve 704 is inserted therethrough. The valve sleeve 706 on the external surface of the body 722 includes dual sealing beads 776 (similar to detent arrangement 718 where the lower sealing bead 776 is the primary seal and the upper sealing bead is the secondary seal) to ensure that there is proper sealing between the valve sleeve 706 and the valve plug 702, when the sleeve 706 is press fit into plug 702.

The valve retainer 708 has a sealing bead arrangement 778 on the exterior cylindrical surface 780. When valve retainer 708 is press fit into valve plug 702, the sealing bead arrangement 788 holds the retainer 708 in plug 702.

In the preferred embodiment, the spring 710 is specified as a thirteen pound (57.8 Newton) spring (in full compression) although the exact spring force will depend upon the opening and closing pressure desired for the trigger 40. The valve plug 702 in a preferred embodiment is made of low density polypropylene for ease of insertion into bottle 22, while the valve 704, the valve sleeve 706, and the valve retainer 708 are comprised of a polyethylene. The polypropylene is preferably one purchased from Eastman Plastics under the designation 1810A Tenite. If one desires to make valve plug 702 more difficult to remove from bottle 22, valve plug 702 can be made of a high density plastic such as high density polypropylene. For all these plastics, a mold release powder is added to the plastic resins in order to facilitate the release of the molded part from the mold.

As can be seen in FIG. 2, the plunger 66 of the filling head 20 engages the valve plunger 124 of the bottle 22 with the plunger 66 fitting into and pushing against the first cylindrical cavity 130 of the valve plunger 124. The recessed cavity 72 of the plunger 66 fits over and receives the head of the metering orifice 136 which is fitted in the valve plunger 124. With the trigger 40 depressed, the plunger 66 urges the valve plunger 124 downwardly to a second position wherein the valve plunger 124 opens both the vent port 104 and the fluid port 106 simultaneously. If at any time the filling head 20 becomes removed from the bottle 22, both of these ports 104, 106 instantaneously close as the spring 144 (FIG. 4*a*) urges the valve plunger 124 to the first closed position preventing any spillage of concentrated chemicals from the bottle 22.

In an alternative embodiment, ball 142 can be replaced with a flat head and an O-ring in order to close fluid port 106.

The bottle 22 further includes identifying indicia 158 (FIG. 2) which in a preferred embodiment can include any one or a combination of optical encoded indicia, magnetically encoded indicia, electrically conductive encoded indicia, or 3-dimensional encoded indicia, or other identifying indicia as may be used in the trade. The filling head 20 includes a reading device 160 which can selectively read indicia 158. It is to be understood that the indicia 158 can include a programmable storage device or strip 162 such as a magnetic or optical strip which can preferably be one time or multiple times writable. The filling head 20 can further include a writing head 164 which can write to the programmable strip 162. The reading device 160 can be associated with an internal information storage device 1 66 which can store information gathered from the indicia 158. The filling head 20 can also include an external communication jack 168 which can be connected as desired to a remote information storage device such as for example a portable computer 170.

Figure 5:
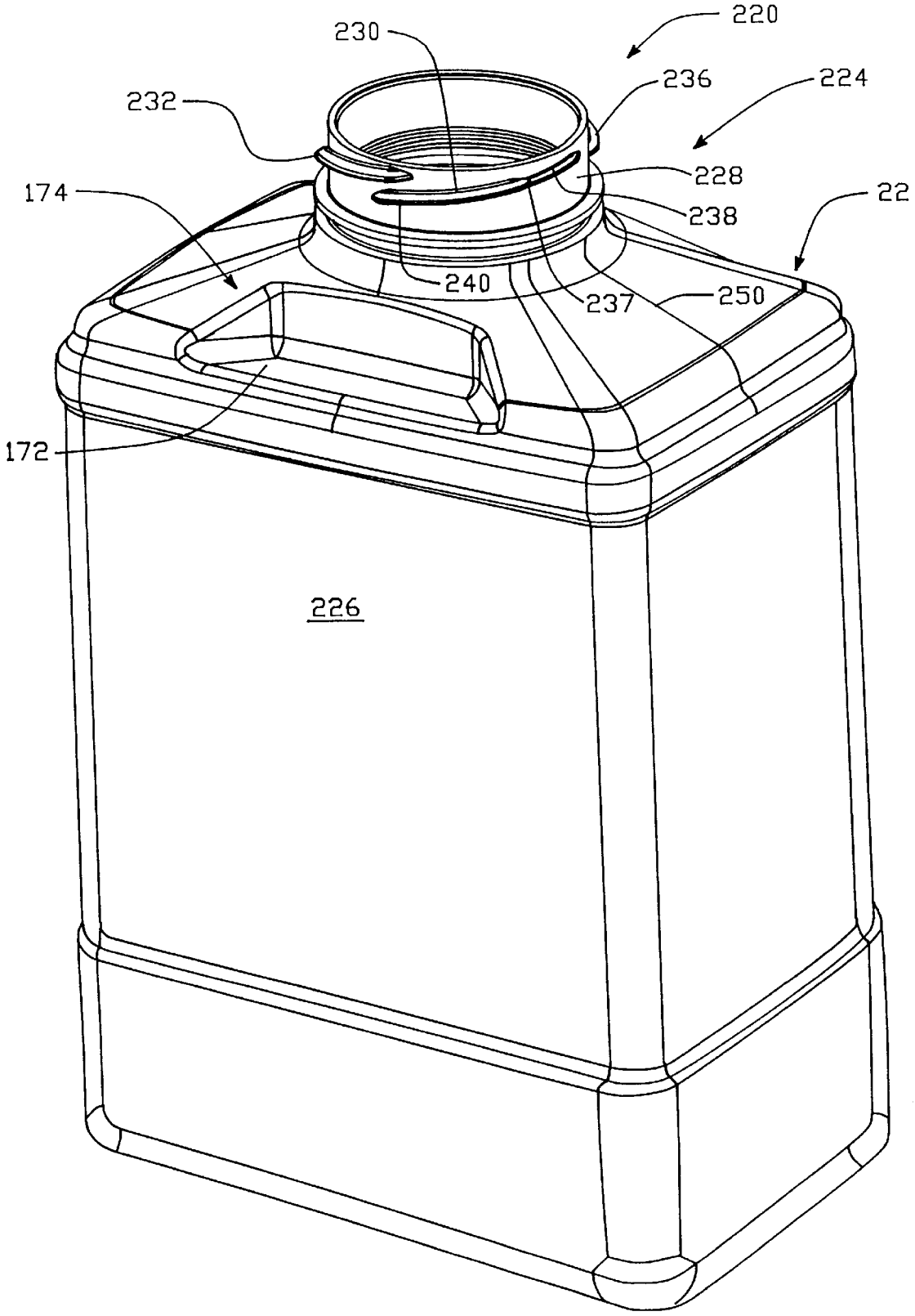
FIG. 5 is a perspective view of an alternative embodiment of a bottle without a bottle interconnecting mechanism in order to show a bottle and filling head alignment mechanism.
Figure 6:
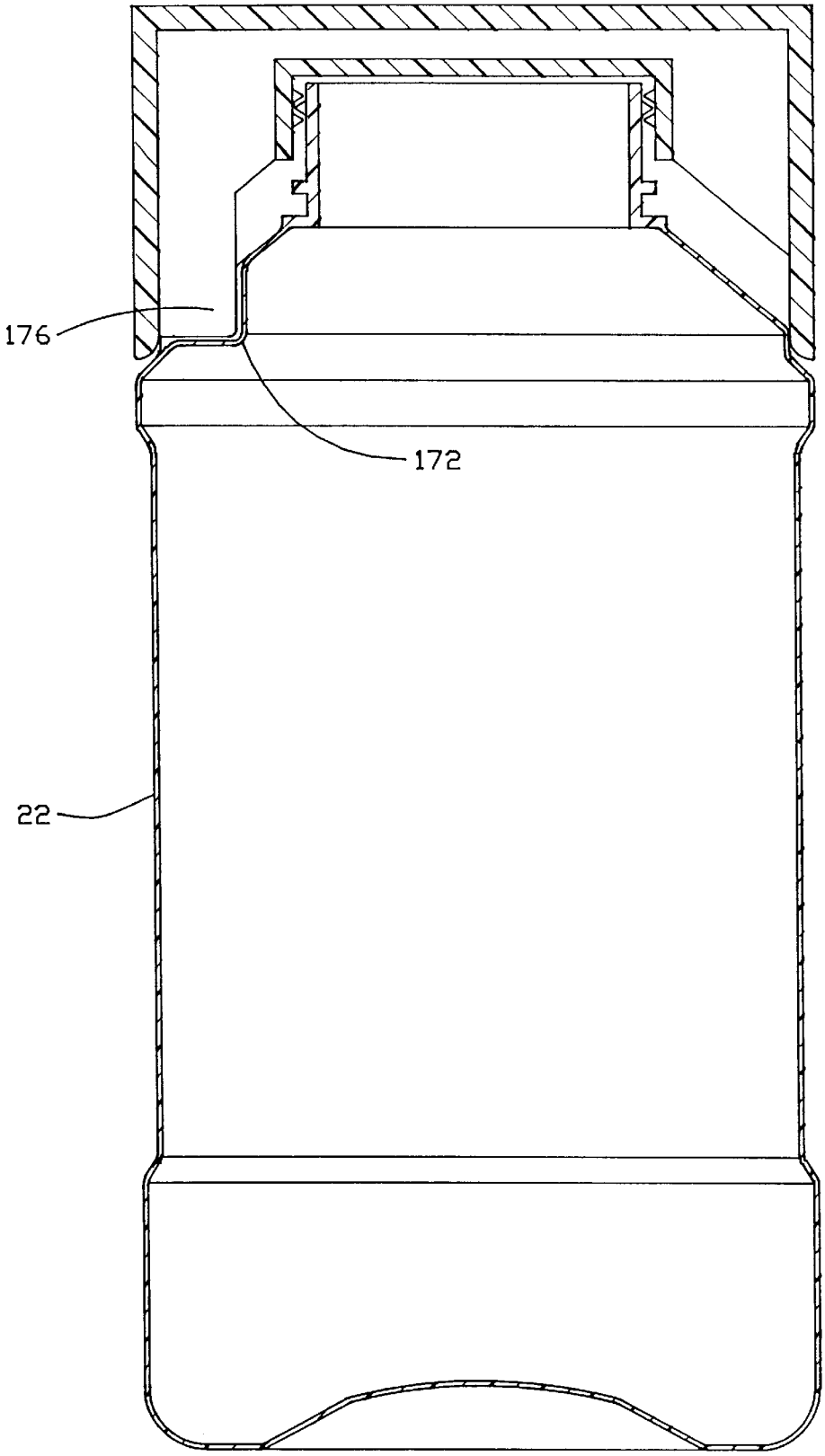
FIG. 6 is a side cross-sectional view of an alternative embodiment of a filling head engaging the bottle of FIG. 5.

A feature of an alternative embodiment of the bottle 22 is depicted in FIGS. 5 and 6. This feature includes an indexing recess 172 located in the top shoulder 174 of the bottle 22. This indexing recess 172 is used to orient the bottle relative to the filling head 20 so that the front wall 156 of the bottle is forward, directly adjacent the filling nozzle 52. Thus the concentrated chemical pickup tube 148 is positioned advantageously in order to ensure that only a residual amount of chemicals is left in a spent bottle as described hereinabove.

As can be seen in FIG. 6, the filling head 20 includes a probe 176 which extends downwardly therefrom. This probe 176 is designed to mate with the indexing recess 172 to ensure that the bottle is correctly oriented with respect to the filling head 20. With the probe 176 of the filling head 20 received in the recess 172 of the bottle, the quarter turn locking handle 84 can be turned in order to secure the bottle 22 to the filling head 20.

Figure 7:
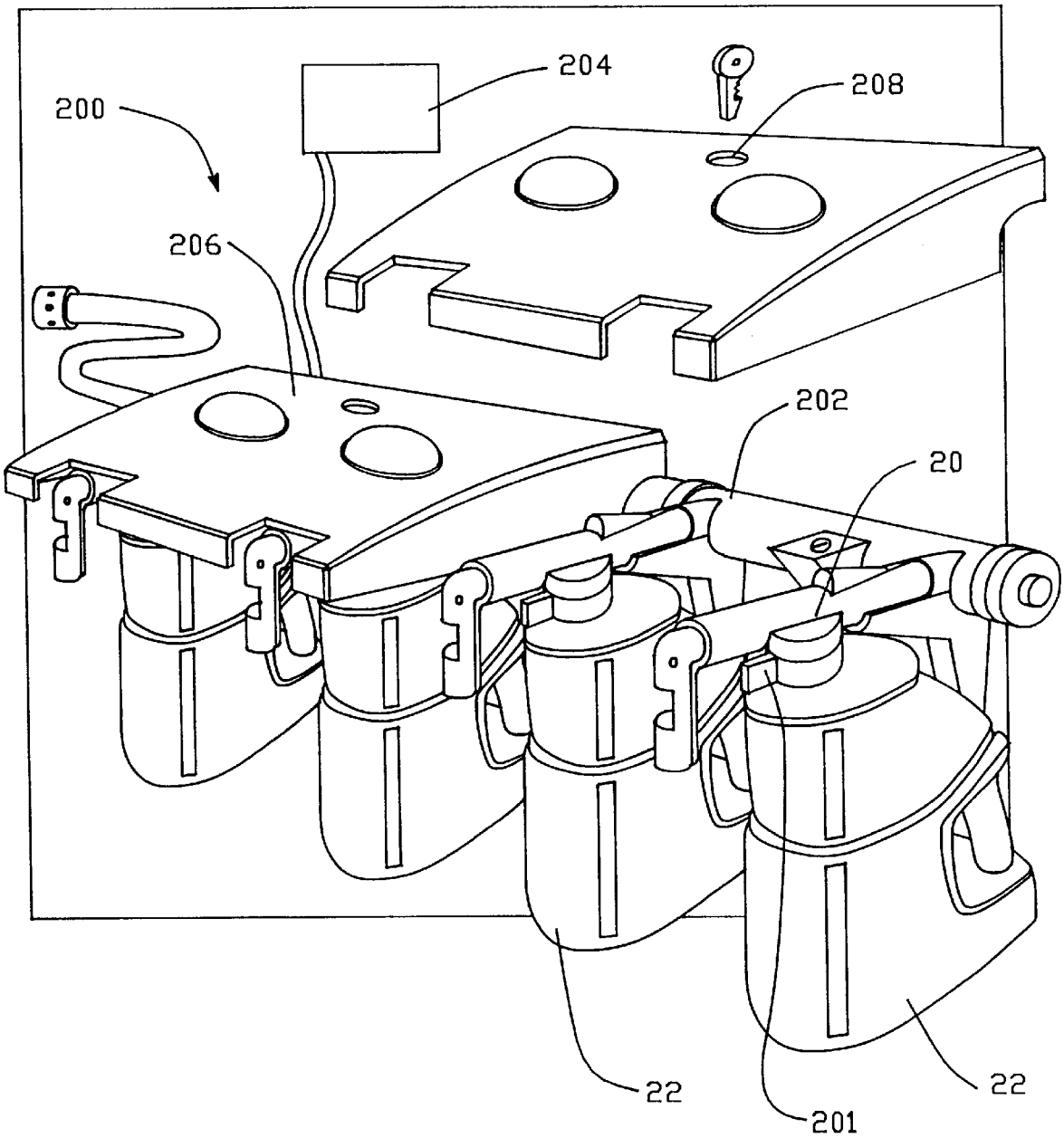
FIG. 7 is a perspective view of a docking station including a plurality of filling heads connected to a manifold, and an information storage device.

A wall mounting docking station of the invention is shown in FIG. 7 and identified by the number 200. Wall mounted docking station 200 can include one or more filling heads 20 which are preferably associated with the common manifold 202 which is communicated with a source of water. It must be understood that in addition to a wall mounting docking station with one or two filling heads 20, such a station can include many more filling heads as desired. The bottles 22 are secured to the filling heads in the manner as described with respect to FIGS. 1 and 2. Bottles 22 in FIG. 7 are similar in function to bottle 22 in FIG. 1 except that the bottles 22 in FIG. 7 have a handle added thereto. Bottles 22 in FIG. 7 are similar in function to bottle 22 in FIG. 1 except that the bottles 22 in FIG. 1 have a handle added thereto. Bottles 22 are removable by turning lever 201. In addition, it must be understood that an information storage device 204 can be associated with a wall mounted docking station. Such information storage device can include a portable computer or a large main computer for the facility which uses the wall mounted docking station 200. As can be seen in FIG. 7, a housing 206 covers the filling heads 20. Housing 206 can be locked into a closed position with lock 208. This arrangement ensures that the filling station 200 cannot be tampered with by unauthorized personnel.

Figure 8:
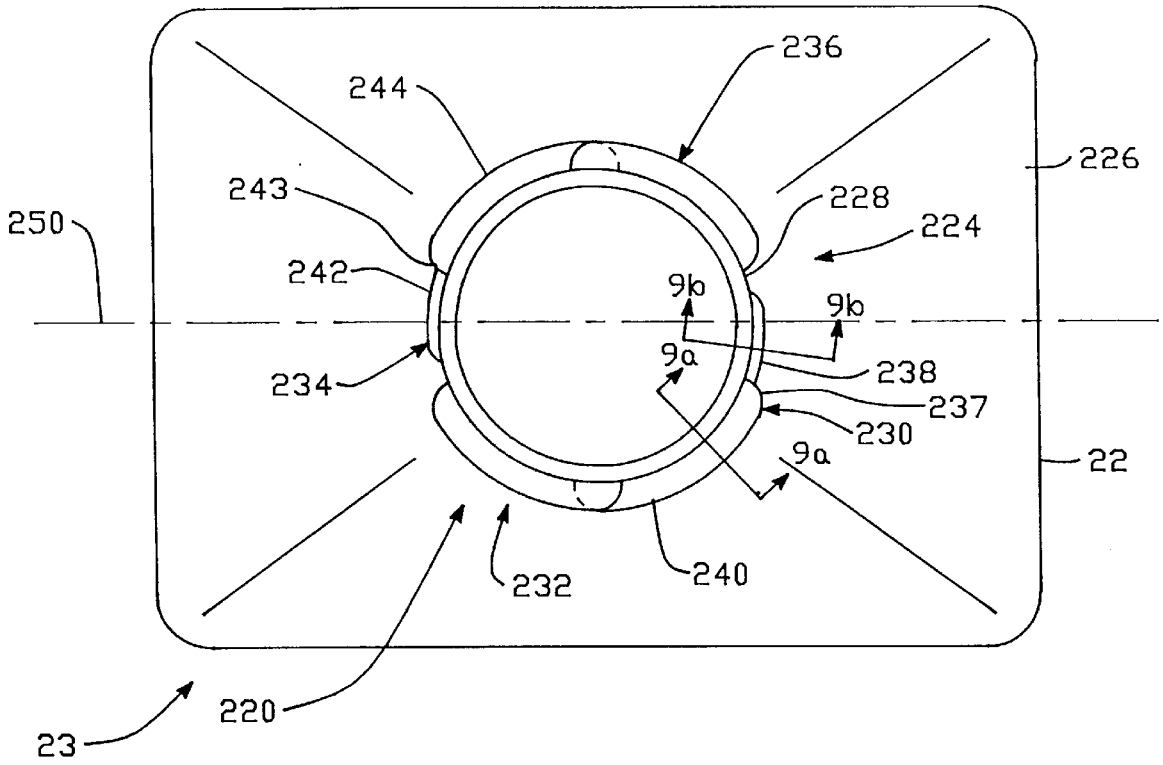
FIG. 8 is a top view of an embodiment of the bottle of the invention.
Figure 9A:
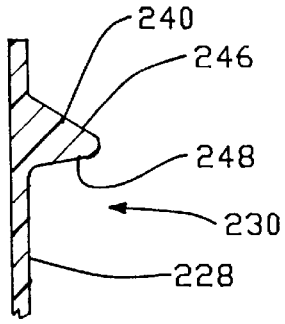
FIG. 9*a* is a partial view which has been sectioned through line 9*a*—9*a* of FIG. 8.
Figure 9B:
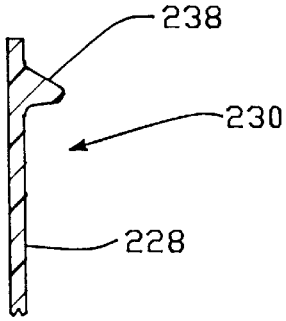
FIG. 9*b* is a partial view which has been sectioned through line 9*b*—9*b* of FIG. 8.

With respect to FIGS. 8–12, a preferred embodiment of a bottle interconnect 220 (FIG. 8) and a filling head interconnect 222 (FIG. 10) of the docking station and bottle system 23 of the invention are depicted. In FIG. 8 (see also FIG. 5), the bottle interconnect 220 includes a neck 224 which is upstanding from the body 226 of the bottle 22. The neck 224 has an exterior cylindrical surface 228. Projecting from the exterior cylindrical surface 228 is a plurality of threads 230, 232, 234 and 236. Preferably, these threads are approximately quarter-turned threads, with each thread located approximately in a separate quadrant about the exterior cylindrical surface 228. Preferably, all these threads start from positions above the body 226 of the bottle 22 and spiral downwardly toward the body 226. In this embodiment, the threads 230, 232, 234 and 236 are discrete threads. In addition, threads 230 and 234 are specially designed in order to ensure proper mating of the bottle 22 to the filling head 20. In particular and as shown in FIG. 8, threads 230 and 234 can be defined as stepped threads. This is because thread 230 include a first reduced thread portion 238, a shoulder 237, and a second full thread portion 240 (FIGS. 8, 9*a*, 9*b*). Similarly, thread 234 includes a first reduced thread portion 242, a shoulder 243, and a second full thread portion 244. The cross sections of thread 230 in FIGS. 9*a* and 9*b* reveal that in this preferred embodiment the thread is designed as a buttress thread for added strength. The buttress thread includes an upper buttress surface 246 (FIG. 9*a*), which adds additional support and strength to the thread profile. The buttress thread further includes a lower power surface 248 which will take the load placed thereon by the mating thread of the filling head without having slippage between the threads of the bottle interconnect 220 and the head interconnect 222. Comparing FIGS. 9*a* and 9*b*, it is evident that the first reduced thread portion 238 has a smaller thread depth than that of second full thread portion 240 of FIG. 9*a*. In the preferred embodiment of this invention, due to the fact that the four threads as shown in FIG. 8 must support the substantial weight of a bottle with fluid therein, and due to the fact that at least two of the threads have a reduced thread portion, the remainder of the threads with the reduced thread portion and the other two threads, have a thread depth of preferably greater than 0.050 inches (1.27 mm), and in this specific embodiment, greater than 0.080 inches (2.032 mm) and specific 0.0835 inches (2.1209 mm). This additional height of these threads ensures that there is enough surface contact between the threads of the bottle and threads of the head in order to adequately support the weight of the bottle fully filled with appropriate concentrate or fluid. Preferably the height of the reduced portion of the thread is about 0.045 inches (1.143 mm). This difference in thread profiles affords several advantages.

One advantage is that the molding of the bottle can be accomplished in an economical and efficient manner. Preferably, the bottle is molded with a mold having two parts which define a mold parting line 250 as seen in FIG. 8. It is evident that the mold parting line in this preferred embodiment projects through the reduced thread portions 238 and 242. As the thread portions 238 and 242 are reduced, they do not interfere with the removal of the molds from about the formed bottle 22. Additionally as will be evident in the discussion of FIGS. 10, 11 and 12, the head interconnect 222 includes protrusions or bumps 252, 254 which preferably mate and wedge against the reduced thread portions 238, 242 in order to position and securely locate the bottle 22 with respect to the filling head 20.

It is to be understood that in an alternative embodiment, the reduced thread portions 238 and 242 can be eliminated, with the embodiment being within the spirit and scope of the invention as claimed. In such an arrangement, the protrusions 252 and 254 of the head interconnect 220 would be enlarged so that they would approach, and if desired, wedge and mate against the exterior cylindrical surface 228.

It is to be understood that in either of these embodiments, there is no requirement that the protrusions 252 and 254, in a final position with respect to the bottle interconnect 220, mate and wedge against the bottle 22 or threads 238, 242. The protrusions 252 and 254 can be spaced from the threads and still fall within the spirit and scope of the invention. The reason for this is that if the bottle is not fully aligned with respect to the filling head, then protrusions may contact the bottle or threads. However, if the bottle is properly aligned and depending on the molding process, the bottle 22 or threads 238, 242 may be spaced apart from the protrusions.

Figure 10:
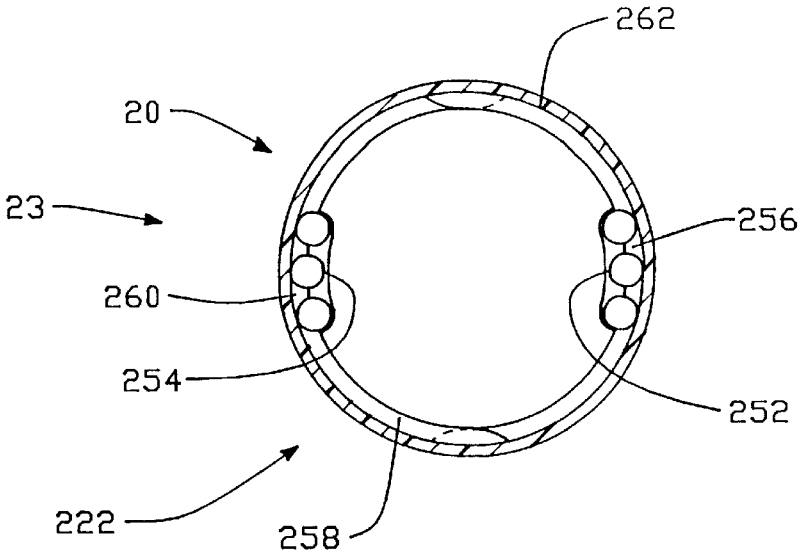
FIG. 10 is a sectioned view through line 10—10 of FIG. 2 depicting a portion of the filling head interconnect which mates with the bottle interconnect of FIG. 8.
Figure 11:
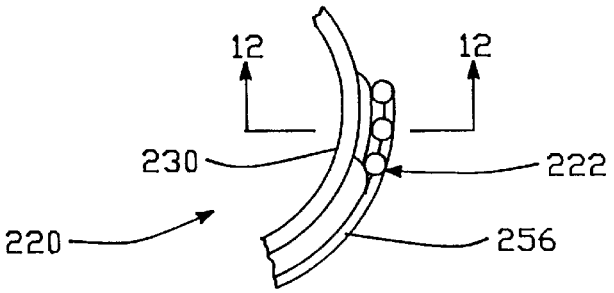
FIG. 11 is a partial view of the bottle interconnect of FIG. 8 mating with the head interconnect of FIG. 10.
Figure 12:
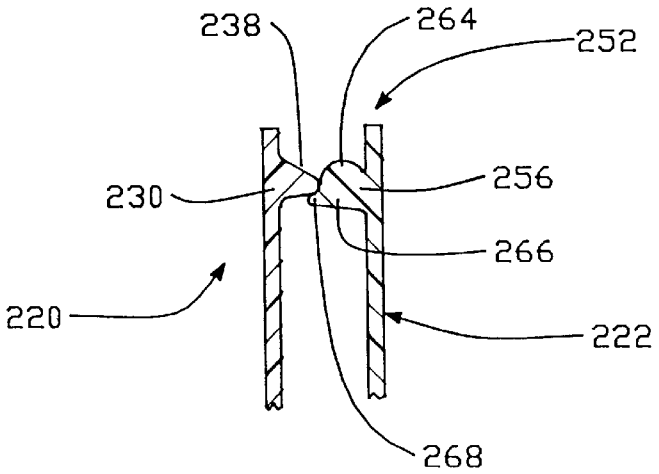
FIG. 12 is a partial view which has been sectioned through line 12—12 of FIG. 11.

Turning to FIGS. 10, 11 and 12, it can be seen that the head interconnect 222 includes threads 256, 258, 260 and 262. Threads 256 and 260 include the above-referenced protrusions 252 and 254. The threads 256 through 262 of the head interconnect 220 mate with the threads 230 through 236 of the bottle interconnect 220 as can be seen with respect to threads 256 and 230 in FIGS. 11 and 12. In FIG. 10 it is evident that the protrusions or bumps 252 are affixed and extend from the tail end of the thread 256 of the head interconnect 222. Similarly, the protrusion 254 extend from the tail end of the thread 260. Turning to FIG. 12, it can be seen that the protrusion 256 includes an enlarged portion 264 which extends above the thread base 266 and is wedged against the reduced thread portion 238 in this preferred embodiment. A small ledge or extension 268 of thread 256 engages the lower surface of the reduced thread portion 238 in this preferred embodiment in order to give some extra support and engagement between the threads. Such ledge or extension is not required in other embodiments in order to be within the spirit and scope of the invention.

Figure 13:
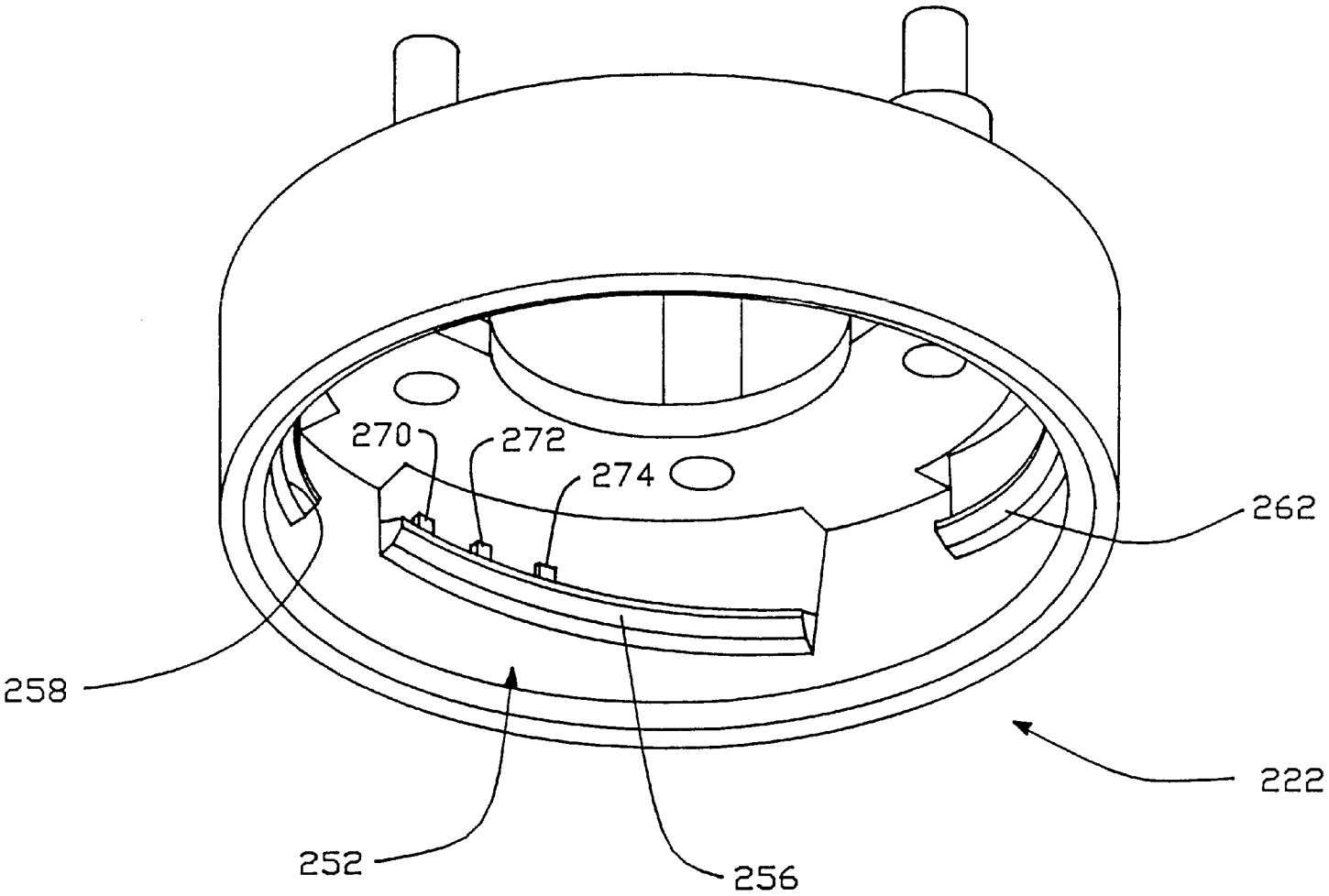
FIG. 13 is an alternative embodiment of the filling head interconnect depicted in FIG. 10.

FIG. 13 is an alternative embodiment of the head interconnect 222 and depicts threads 256, 258, and 262. Also depicted is a protrusion 252. In this embodiment the protrusion 252 includes three rectangular-shaped blocks 270, 272, and 274. These blocks are positioned above 702. the thread 256 at the trailing edge thereof. The thread 256 is designed to support both the first reduced thread portion 238 and the second full thread portion 240 of the thread 230 of the bottle interconnect 220 (FIG. 5). The blocks 270, 272, and 274 which are mounted on at 256 are set back somewhat from the leading edge of thread 256 and are designed to engage and/or position the first reduced thread portion 238 of bottle interconnect 220. In one aspect, these blocks 270, 272, and 274 can wedge up against first reduced thread portion 238 in order to create a locking effect. Also, without creating such a locking effect, these blocks 270, 272 and 274 can position reduced thread portion 238 so that the bottle interconnect 220 (FIG. 8) is appropriately centered with respect to the head interconnect 222 (FIG. 13). It is to be understood that similar blocks can be mounted on opposite thread 260 (which is shown in FIG. 10 but not in FIG. 13).

Figure 14:
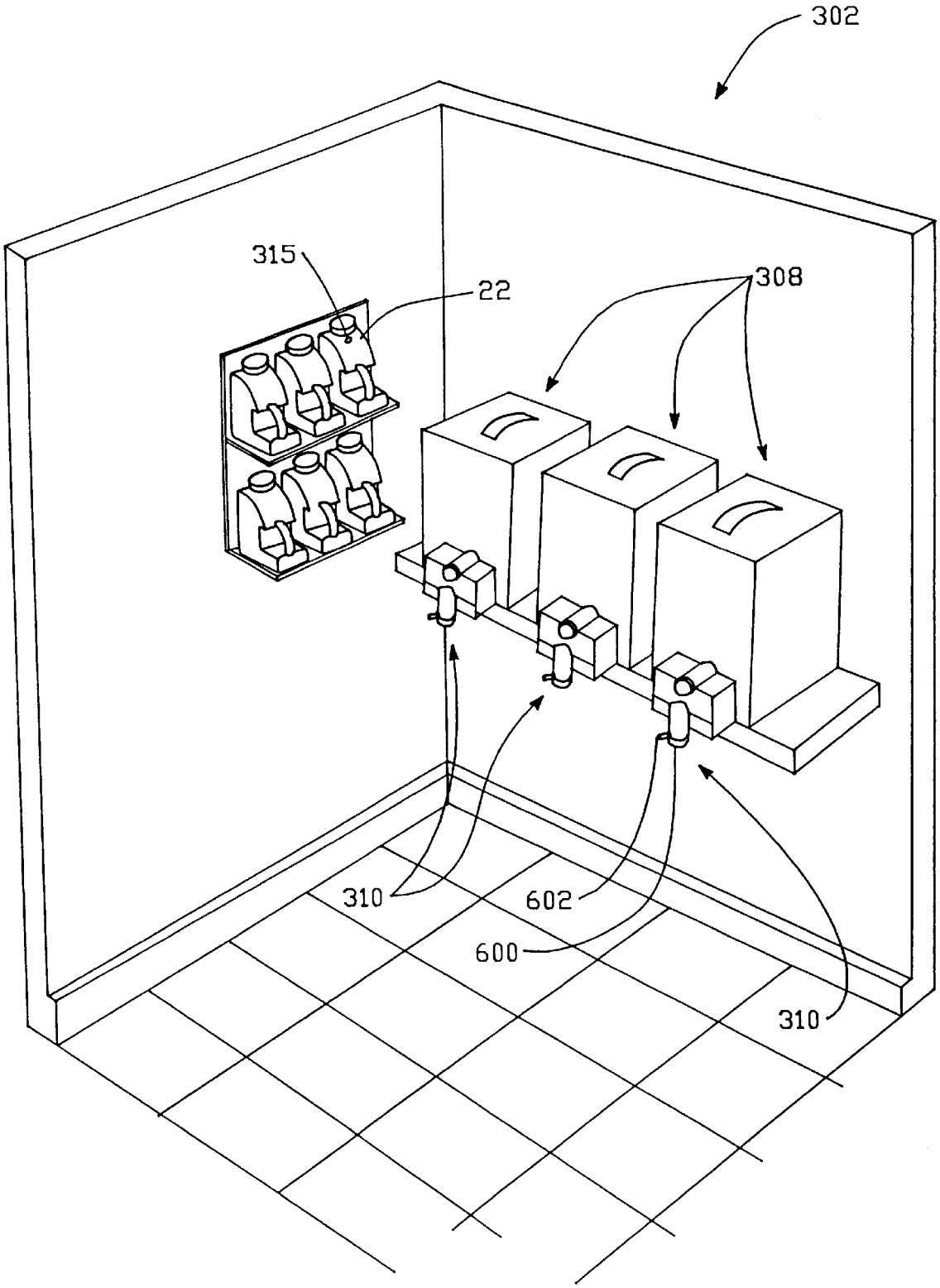
FIG. 14 is a concentrate dispensing station.

As can be seen in FIG. 14, a central station 302 for refilling bottles 22 is comprised of a plurality of bulk multi-gallon (multi-liter) containers 308 which store large amounts of the concentrated chemical fluids. One typical size would be an 18 gallon (68.1 liter) container. These containers 308 can be delivered by the supplier and fitted to a dispensing or refill head 310 which dispenses the concentrated chemical fluids as needed. Generally the dispensing heads will not dilute the concentrated chemical fluids. Also mounted in the central station 302 is a plurality of delivery bottles 22. The delivery bottles 22 can be of the design discussed herein with respect to FIGS. 1 or 7. However, other designs for these bottles would be within the spirit and scope of the invention. In operation, the delivery bottles 22 are filled or refilled directly from the dispensing head 310 with the concentrated chemical fluids delivered in bulk container 308.

The dispensing or refill head 310 of the central station 302 (FIG. 14) can include in a preferred embodiment a dispensing or refill head plunger 600 (FIGS. 14, 15*a*, 15*b*, and 15*c*). Refill head plunger 600 can be moved in and out of engagement with the delivery bottles 22 for purposes of filling same. In one embodiment, a quarter turn of lever 602, locks the delivery bottle 22 to the head 310 much the same way that a quarter turn of locking handle 84 (FIG. 1) locks the delivery bottle 22 to the filling head 20 of FIG. 1.

Alternatively, the plunger 600 can be stationary with the bottle 22 urged against the plunger 600 in order to refill the bottle using the same procedures as outlined below with respect to FIGS. 15*f* and 15*g*.

Figure 15A:
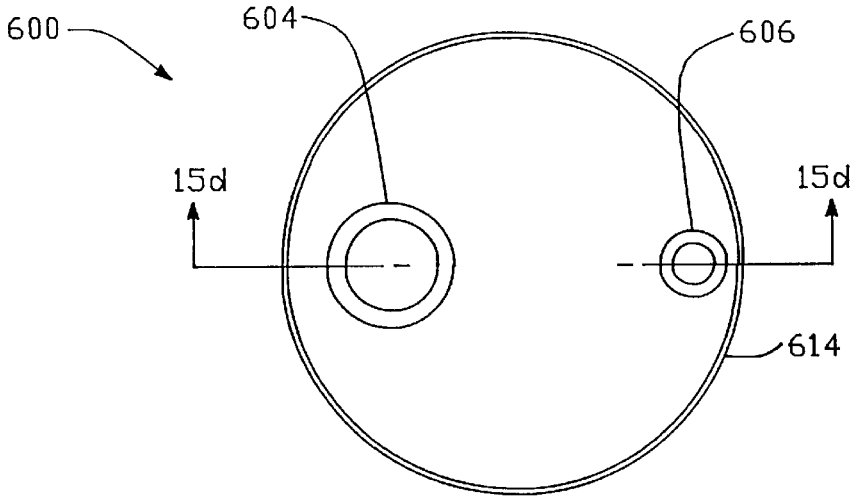
FIGS. 15*a*, 15*b*, and 15*c* depict top, side and bottom views of an embodiment of a dispensing or refill head which can be used to refill the bottles as depicted in FIGS. 1 and 7.
Figure 15B:
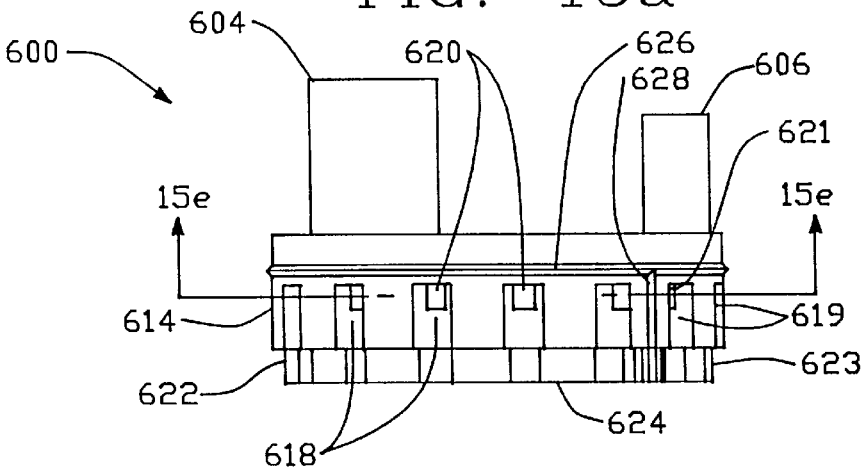
Figure 15C:
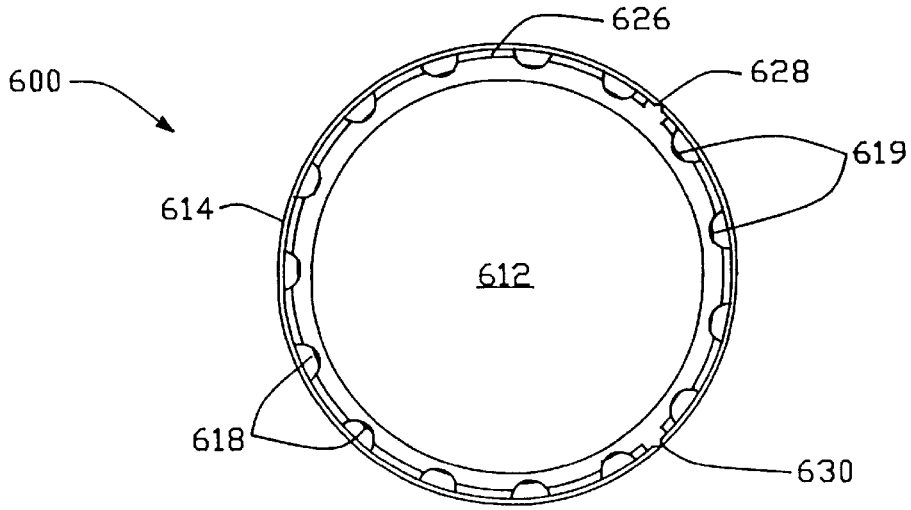
Figure 15D:
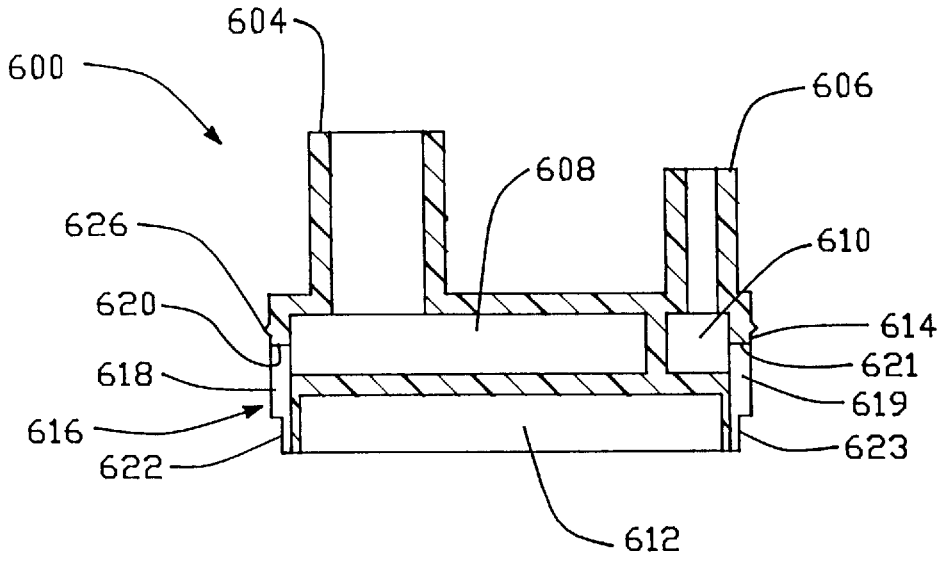
FIG. 15*d* is a cross-sectioned view taken through FIG. 15*a*—15*a*.
Figure 15E:
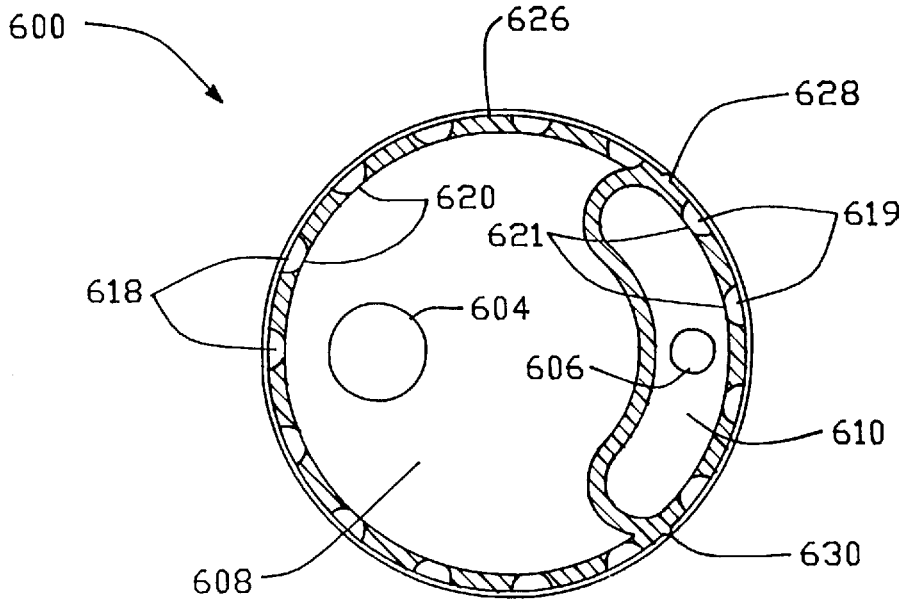
FIG. 15*e* is a cross-sectioned view taken through FIG. 15*b*—15*b*.

FIGS. 15*a*, 15*b*, and 15*c* depict the top, side, and bottom view of the refill head plunger 600. As can be seen in FIGS. 15*a* and 15*b*, the plunger 600 includes a concentrate inlet port 604 and an air vent 606. The concentrate inlet port 606 (FIGS. 15*d* and 15*e*) communicates with an internal plenum 608. The air vent 606 communicates with an internal plenum 610. Below plenums 608, 610 is a recess 612 defined by a downwardly dependent peripheral wall 614. Recess 612 is adapted to mate with a valve plunger 124 (FIG. 4*a*) as will be more fully described with respect to FIGS. 15*f* and 15*g*. The peripheral wall 614 describes a right circular cylinder with a peripheral external surface 616. Described on the external surface 616 are a first plurality of semi-cylindrical or scalloped recesses 618 and a second plurality of semi-cylindrical or scalloped recesses 619 (FIG. 15*e*). Recesses 618 communicate through a plurality of port 620 with the internal plenum 608 and recesses 619 communicate through a plurality of port 621 with the internal plenum 610. FIGS. 15*b*, 15*c*, and 15*d*, the external surface 616 includes first and second peripheral indentations 622, 623 which are located at the bottom 624 of the external surface 616. First indentation 622 communicates with all of the recesses 618 which in turn communicate with the internal plenum 608. Second peripheral indentation 623 communicates with the recesses 619 which communicate with the internal plenum 610. Plunger 600 includes a first sealing gasket 626 which is located circumferentially about the external surface 616, and second and third sealing gaskets 628, 630 which are downwardly dependent from gasket 626 and which confines the scalloped recess 619 which provides for the venting of air.

Figure 15F:
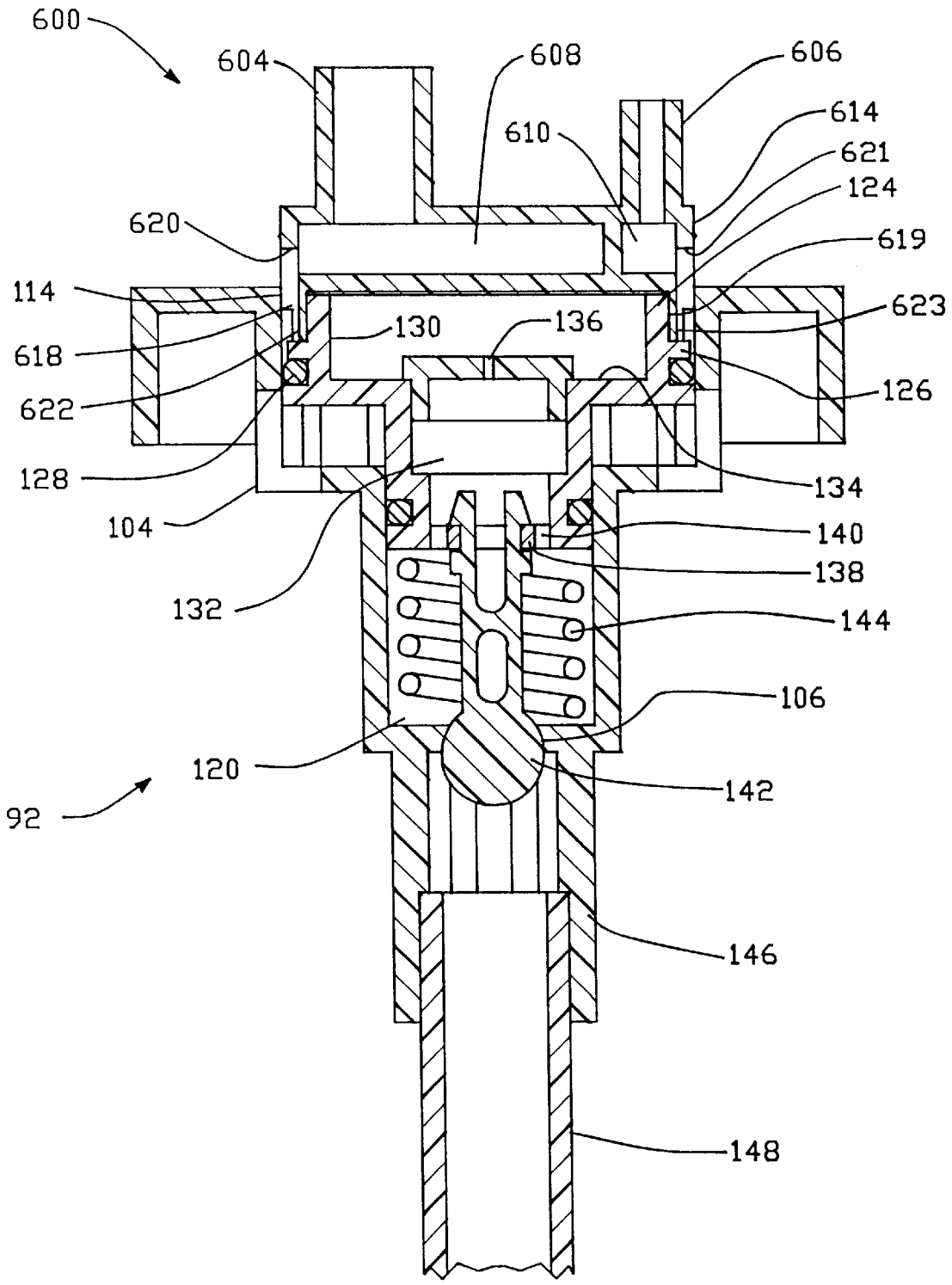
FIG. 15*f* is a cross-sectioned view of the refill head shown in FIG. 15*d*, positioned above a valve mechanism, similar to the valve mechanism shown in FIG. 4*a*.
Figure 15G:
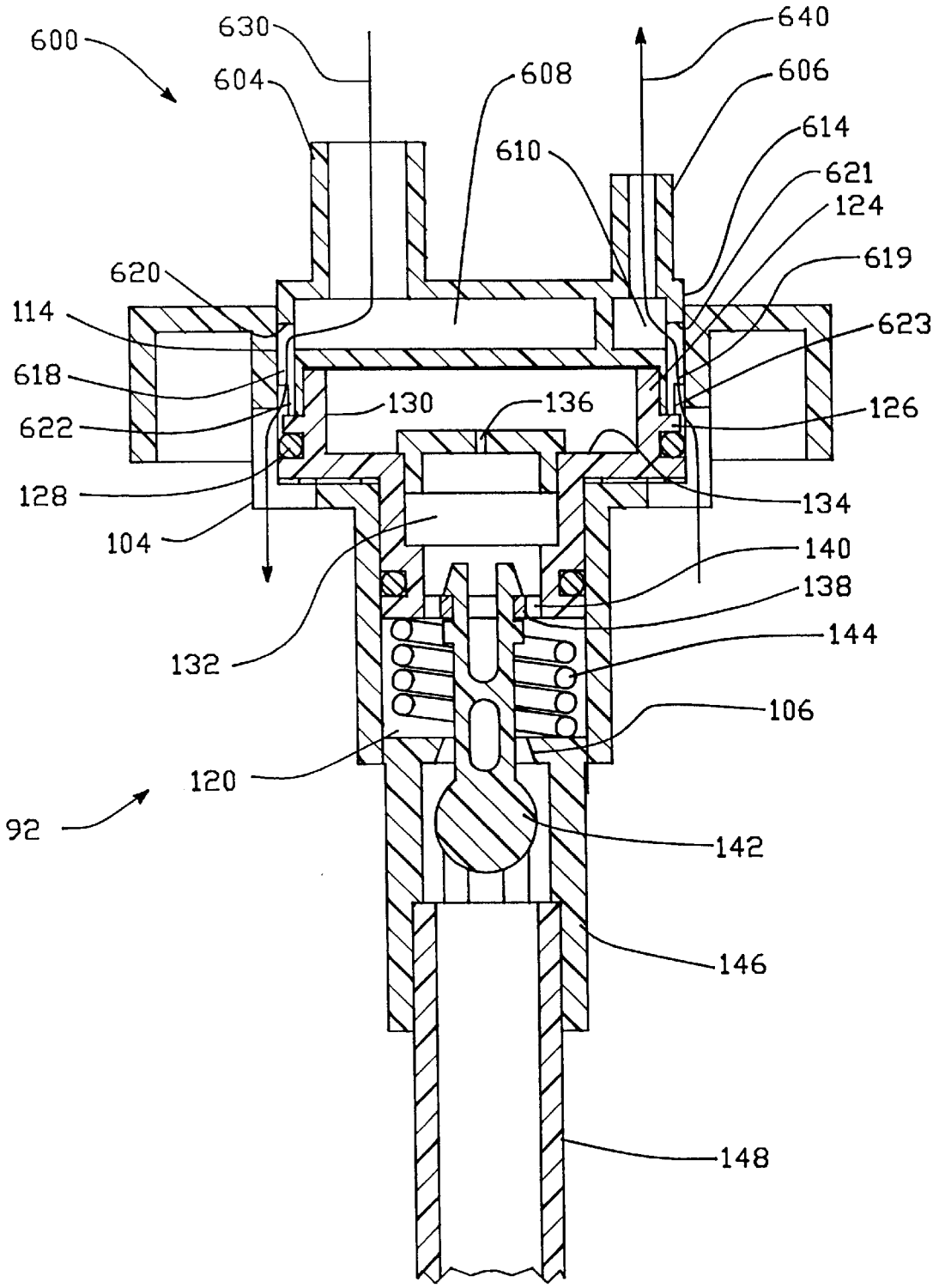
FIG. 15*g* is a cross-sectioned view similar to FIG. 15*f* but with the refill head pressing the valve plunger of the valve mechanism into an open position.

Turning to FIGS. 15*f* and 15*g*, the refill head plunger 600 is shown mated to the valve plunger 124 of the valve mechanism 92 (FIG. 4*a*). In FIG. 15*f*, recess 612 receives the upper end of the first cylindrical cavity 130 of the valve plunger 124. The peripheral wall 614 of plunger 600 is received about the plunger 124. The peripheral wall 614 is additionally received adjacent to the peripheral wall 114 of the valve mechanism 92. With respect to FIG. 15*f*, the valve plunger 124 is still in its closed position and thus no fluid passes between the filling head 600 and the bottle 22 (not shown).

In FIG. 15*g*, the valve plunger 124 is in a depressed and opened position so that concentrated fluid can communicate and be dispensed into the bottle 22 (not shown), in order to refill the bottle. This is accomplished by using the movement of the refill head plunger 600 to urge the valve plunger 124 into the second open position or by causing the plunger 124 to be urged up against a stationary fill head plunger 600 and thus positioned into the open position as shown in FIG. 15*g*. Concentrate is dispensed into the bottle along, for example, path 630. Air is vented from the bottle along path 640. Examining path 630, concentrate enters the concentrate inlet port 604 and proceeds to the internal plenum 608. From there it exits port 620 to scalloped recesses 618 to peripheral indentation 622 to the vent port 104 of the valve mechanism 92 of the bottle in order to fill the bottle. As the bottle is filled, air is vented from the bottle through vent port 104 through the peripheral indentation 623 to the scalloped recesses 619 and the port 621 to the internal plenum 610 and out the air vent 606. Once the refilling operation is complete, the bottle 22 is removed from the refill head 310 and the valve plunger 124 reverts to the first closed position (shown in FIG. 15*f*), closing off the fluid port 106 and the vent port 104 so that no fluid can spill from the bottle 22. The bottle can then be transported to a new location, such as for example, a satellite station.

Industrial Applicability

As can be seen from the above, the present invention satisfies the needs of safety, economy and efficiency not met by the prior art. The present invention provides a filling head 20 and bottle 22 which can be conveniently mated and which ensures that concentrated chemicals cannot be inadvertently spilled from the bottle. Further, the design of the filling head 20 is such that the concentrated chemicals cannot be dispensed from the filling head 20 until its chemicals are mixed with the water to avoid any contact of the concentrated chemicals with any personnel. Additionally, should the bottle 22 be inadvertently squeezed during distribution and handling, no concentrated chemicals will be urged out of the bottle.

The present system further provides a mechanism for tracking the utilization of concentrated chemicals in order to determine if the concentrated chemicals are being optimally used and applied.

Other features, aspects and objects of the invention can be obtained from a review of the figures and the claims.

It is to be understood that other embodiments of the invention can be developed and fall within the spirit and scope of the invention and claims.

We claim:

1. A bottle adapted to be secured to a filling head comprising:

a valve body with a longitudinal axis;

said valve body including a vent port and a first channel with a distal end;

a plunger contained within said valve body;

said plunger defining a second channel and a fluid port communicating with said second channel;

said plunger positioned in first channel; and said plunger having a first position wherein said vent port and said fluid port are closed, and a second position wherein said vent port and said fluid port are open, with said fluid port extending past said distal end of said first channel, and said plunger movable between the first position and the second position as said plunger moves along said longitudinal axis.

2. The bottle of claim 1 wherein:

said vent port includes a plurality of vent ports located about said first channel.

3. The bottle of claim 1 wherein:

said fluid port is located along a line which is at an angle to said axis.

4. The bottle of claim 1 wherein:

said plunger has a column with an external surface with the second channel defined in the column;

said column has a proximal end and a distal end;

said fluid port is located adjacent said distal end through said external surface of said column;

said plunger has an enlarged portion extending from the proximal end of said column, which enlarged portion causes said vent port to be selectively open and selectively closed.

5. The bottle of claim 1 wherein:

said plunger has a third position which allows the bottle to be refilled through said vent port.

6. A bottle adapted to be secured to a filling head comprising:

a valve body;

said valve body including a vent port and a first channel with a distal end;

a plunger;

said plunger defining a second channel and a fluid port communicating with said second channel;

said plunger positioned in first channel;

said plunger having a first position wherein said vent port and said fluid port are closed, and a second position wherein said vent port and said fluid port are open, with said fluid port extending past said distal end of said first channel;

said plunger moves along an axis between the first position and the second position; and wherein said fluid port is located along a line which is at an angle to said axis.

7. A bottle adapted to be secured to a filling head comprising:

a valve body;

said valve body including a vent port and a first channel with a distal end;

a plunger;

said plunger defining a second channel and a fluid port communicating with said second channel;

said plunger positioned in first channel;

said plunger having a first position wherein said vent port and said fluid port are closed, and a second position wherein said vent port and said fluid port are open, with said fluid port extending past said distal end of said first channel;

said plunger moves along an axis between the first position and the second position;

said plunger has a third position which allows the bottle to be refilled through said vent port; and said third position is located along said axis such that said plunger moves along said axis from said first position past said second position to said third position.

* * * * *